US010960448B1

(12) United States Patent
Djavanroodi

(10) Patent No.: US 10,960,448 B1
(45) **Date of Patent: *Mar. 30, 2021**

(54) PROCESS FOR EQUAL CHANNEL ANGULAR PRESSING FINE GRAIN TITANIUM ROUND TUBE

(71) Applicant: Prince Mohammad Bin Fahd University, Dhahran (SA)

(72) Inventor: Faramarz Djavanroodi, Dhahran (SA)

(73) Assignee: Prince Mohammad Bin Fahd University, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/990,192

(22) Filed: Aug. 11, 2020

Related U.S. Application Data

(63) Continuation of application No. 16/738,244, filed on Jan. 9, 2020.

(51) Int. Cl.
*B21C 23/12* (2006.01)
*C22F 1/18* (2006.01)

(52) U.S. Cl.
CPC ..... *B21C 23/12* (2013.01); *C22F 1/183* (2013.01)

(58) Field of Classification Search
CPC ..... B21C 23/12; C22F 1/183
See application file for complete search history.

(56) References Cited

U.S. PATENT DOCUMENTS 6,399,215 B1 * 6/2002 Zhu ..... B21C 23/001 148/407
10,323,311 B2 * 6/2019 Colombo ..... C22F 1/183

FOREIGN PATENT DOCUMENTS

| | | | |
|---|---|---|---|
| CN | 10-0666478 | B1 | 1/2007 |
| CN | 102743233 | A | 10/2012 |
| CN | 103252377 | A | 8/2013 |
| CN | 103572186 | B | 10/2015 |
| CN | 106086739 | B | 9/2017 |
| CN | 108723110 | A | 11/2018 |
| CN | 107824625 | B | 7/2019 |

OTHER PUBLICATIONS

Ebrahimi et al., "Equal channel angular extrusion for tube configuration of Al—Zn—Mg—Cu alloy," Materials Science & Engineering A, 731 (2018), pp. 569-576. (Year: 2018).*

(Continued)

*Primary Examiner* — John A Hevey
(74) *Attorney, Agent, or Firm* — Oblon, McClelland, Maier & Neustadt, L.L.P.

(57) ABSTRACT

A process to fabricate ultra-fine grain metal hollow object, comprising: inserting an annealed hollow prototype in an Equal Channel Angular Pressing (ECAP) die, providing a flexible elastic polyurethane mandrel to fill the central hollow space, optionally (if needed) provide polyurethane support to fill the spaces between the outer boundary of the prototype and the inner surface of the ECAP channel and to exert sufficient pressure to complete the ECAP process. The process is designed to improve thermal conductance and mechanical properties of hollow metal parts and is especially applicable to achieving the maximal heat conductance and tensile strength of titanium piping, construction tubing, and cylindrical reactors.

6 Claims, 6 Drawing Sheets

(56) References Cited

OTHER PUBLICATIONS

Ravisankar et al., "ECAP of Commercially Pure Titanium: A Review," Trans. Indian Inst. Met., vol. 61, No. 1, Feb. 2008, pp. 51-62. (Year: 2008).*

Naseri et al., "A comparison of axial fatigue strength of coarse and ultrafine grain commercially pure titanium produced by ECAP," Archives of Civil and Mechanical Engineering, 18, (2018), pp. 755-767. (Year: 2018).*

F. Djavanroodi, et al., "Experimental investigation of three different tube equal channel angular pressing techniques", KovovéMater., vol. 53, Issue 1, 2015, pp. 27-34.

M. Krystian, et al., "Equal Channel Angular Pressing (ECAP) of hollow profiles made of titanium", 7$^{th}$ International Conference on Nanomaterials by Severe Plastic Deformation, IOP Conference Series: Materials Science and Engineering, vol. 194, 2017, pp. 1-6.

Fahad Al-Mufadi, et al., "Equal-Channel Angular Pressing of Thin-Walled Copper Tube", Arabian Journal for Science and Engineering, vol. 40, No. 9, Jul. 2015, pp. 2785-2794.

M. Borhani, et al., "Rubber pad-constrained groove pressing process: Experimental and finite element investigation", Materials Science and Engineering A, vol. 546, Jun. 2012, pp. 1-7.

Muhammad Waqar Ashraf, et al., "Adsorption Studies of Textile Dye (Chrysoidine) from Aqueous Solutions Using Activated Sawdust," International Journal of Chemical Engineering, Article ID: 9728156, 2019, 8 pages.

F. Djavanroodi, et al., "Equal Channel Angular Pressing of Tubular Samples", ACTA Metallurgica Sinica (English Letters), vol. 26, No. 5, Oct. 2013, pp. 574-580.

Faramarz Djavanroodi, et al., "Route Effect on Equal Channel Angular Pressing of Copper Tube", ACTA Metallurgica Sinica (English Letters), vol. 27, No. 1, 2014, pp. 95-100.

* cited by examiner

Longer path FEA
Shorter path FEB
Plunger
Die
Sample
Φ=90°
Φ
ψ
ψ=37°

Φ= 120
Z
X
Y

Pressure
Die
Sample
Φ=90°
y(ND)
x(ED)
z(TD)
ψ=37°

Pressed sample

90° standard back slant front slant

PROCESS FOR EQUAL CHANNEL ANGULAR PRESSING FINE GRAIN TITANIUM ROUND TUBE

CROSS-REFERENCE TO RELATED APPLICATIONS

The present application is a Continuation of Ser. No. 16/738,244, pending, having a filing date of Jan. 9, 2020.

BACKGROUND OF THE INVENTION

Technical Field

The present disclosure relates to a method of manufacturing titanium pipe with enhanced mechanical properties by applying Equal Channel Angular Pressing (ECAP).

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Titanium is a light and durable construction metal, and titanium tubing (e.g., pipe) has multiple industrial applications in oil, gas and LNG transportation, heat transfer and heat exchangers (See US2017/074599), engine exhaust pipes (See U.S. Pat. No. 8,431,231), aerospace, turbines, power plants, boilers. Among other beneficial properties, titanium tubes withstand high temperatures without creep, have superior resistance to fatigue and crack growth, have a high strength-to-density ratio, and exhibit corrosion resistance. The combination of properties prevents mechanical failures of hollow elements under conditions of high temperature, moderate corrosivity and repetitive dynamic loads, such as observed in boiling equipment.

US6399215BA discloses ultrafine-grained titanium. A coarse-grained titanium billet is subjected to multiple extrusions through a preheated equal channel angular extrusion (ECAE) die, with billet rotation between subsequent extrusions. The resulting billet is cold processed by cold rolling and/or cold extrusion, with optional annealing. The resulting ultrafine-grained titanium has greatly improved mechanical properties and is used to make medical implants. However, the publication does not describe processing of pipe structure and is not ECAP.

Three methods to fabricate ultra-fine grain tube-shaped specimens have been proposed and tested using conventional equal channel angular pressing (ECAP) die with a channel angle of 90°. Pure copper tubes have been subject to three passes. Sand (S-ECAP), rubber (R-ECAP) and grease (G-ECAP) were used as a mandrel to maintain tubular shape of samples during deformation processes. Hardness values and thickness variations of the deformed tubes were measured and compared. To confirm the reduction of grain size, the microstructures of the copper tube before and after equal channel angular pressing were also examined using optical and scanning electron microscopy. The results imply that although all three tube production methods lead to the improvement of hardness magnitudes, R-ECAPed and G-ECAPed tube samples give higher hardness magnitude and better hardness distribution uniformity, respectively. Furthermore, the outcomes denote that R-ECAP gives the least tube wall thickness changes as compared to S-ECAP and G-ECAP processes (See F. Djavanroodi, A. A. Zolfaghari, M. Ebrahimi, *Kovove Mater,* 2015; 53, 27-34). A similar publication discloses the production of copper tubes with the different patterns of tube rotation (routes) between the ECAP passes (See F. Djavanroodi, A. A. Zolfaghari, M. Ebrahimi and K. Nikbin, *Acta Metall. Sin.* (*Engl. Lett.*), 2014, 27(1), pp. 95-100). However, copper and titanium are very distinct metallurgically and the results obtained in these references for copper are not directly transferable to titanium.

Deformation behavior of a copper tube sample was numerically analyzed during the first pass of tubular ECAP process. The investigation included the e□ect of various tube wall thicknesses on the e□ective strain magnitude and strain distribution uniformity. It is shown that tube wall thickness of 3.5 mm gives the optimum value for strain behavior. In addition, copper tube specimens with 3.5 mm wall thickness have been successfully ECAPed up to four passes with the die channel angle of 90° using flexible polyurethane rubber pad. Micro-hardness measurements on both annealed and ECAPed tubes show that 33% and 57% increases in hardness value and also, 50% and 70% reductions in the grain size were achieved after the first and fourth passes, respectively. Furthermore, tube wall thickness measurements show that the process does not change the dimension of deformed specimens (F. Djavanroodi, A. A. Zolfaghari, M. Ebrahimi and K. M. Nikbin, *Acta Metall. Sin.* (*Engl. Lett.*), 2013, Vol. 26 No. 5 pp. 574-580). The results were produced in-silico, were applied to copper, and are not applicable to titanium.

Thin-walled copper tube specimens with 1 mm wall thickness and 23 mm diameter have been successfully ECAPed up to four passes with the die channel angle of 90° using flexible polyurethane rubber pad. Hardness measurements on both annealed and ECAPed tubes show that 90% increase in hardness value and also 200% reduction in the grain size were achieved after four passes. Furthermore, the thickness measurement taken from several locations of the tube indicated that the process did not change the dimension of the deformed specimens (F. Al-Mufadi & F. Djavanroodi, *Arabian Journal of Science and Engineering,* 2015, V40, pp 2785-2794). However, the method was applied to copper. The results are not transferable to titanium due to the distinct metallurgical characteristics.

Microstructural evolution to ultrafine grains and consequently, enhancement of mechanical properties has been recently considered for tube-formed specimens using various severe plastic deformation methods. In this research, Al—Zn—Mg—Cu tube was processed by equal channel angular extrusion using a polyurethane mandrel for up to two passes at room temperature. Although the strength and hardness of the aluminum tube were increased dramatically after the first pass, the aforementioned parameters were enhanced only slightly during the second pass. Also, tube hardness uniformity was decreased remarkably by the first pass and improved for the second pass. According to the parameters of work-hardening behavior and formability, the flow stress rate of the aluminum tube is reduced by increasing the ECAE pass number. Microstructural analyses showed that low angle and straight grain boundaries of the initial sample are transformed into the high angle wavy grain boundaries after introducing the second pass of the process (See M. Ebrahimi, M. H. Shaeri, R. Naseri, and C. Gode, *Materials Science and Engineering: A.* 2018, 731, 569-76). The use of polyurethane as a mandrel was disclosed, but the alloy (Al—Zn—Mg—Cu) differs from both copper and titanium, and high variation in the field indicates that the result is not transferable to titanium.

A severe plastic deformation (SPD) process named rubber pad-constrained groove pressing (RP-CGP) has been developed for producing ultrafine-grained metallic materials. In this process, repetitive shear deformation conditions are imposed on a sheet material by utilizing an asymmetrically grooved die and a polyurethane rubber pad instead of the rigid top die, as in the CGP, through alternate pressing. Commercially pure aluminum sheet was subjected to repetitive deformation using RP-CGP under two conditions utilizing two dies with different groove angles. Tensile tests showed a significant enhancement in mechanical properties including hardness, yield strength, and ultimate tensile strength, but a reduction in the ductility of the alloy. The influence of the die groove angle on strain distribution throughout the transverse cross-section of the specimen was analyzed by the finite element method in 2D plain strain condition using the commercial finite element code ABAQUS. It is shown that a die with a larger groove angle can result in better grain refinement and mechanical properties but cause a less uniform plastic strain distribution throughout the specimen (See Bohrani et al., *Materials Science and Engineering: A,* 2012, Volume 546, Pages 1-7). However, the work was in silico, while the field is poorly reproducible and actual experimentation has not been conducted.

An equal channel angular pressing die with the $\Phi=90°$, $\Psi=15°$ and d=19.2 mm has been applied to pure copper in the shape of tubular samples with a wall thickness of 3.5 mm. The workpiece was ECAPed up to four passes by route C using a polyurethane rubber pad. The magnitudes of hardness at the di□erent locations of both un-ECAPed and ECAPed tubes after first and fourth passes were obtained and compared using micro-hardness tests. The influence of tube wall thickness on the e□ective strain magnitude and strain distribution uniformity was numerically analyzed for the first pass of the tubular ECAP process. The following conclusions can be drawn: (1) The FEM results on the first pass of ECAP process indicated that increasing tube wall thickness results in higher e□ective strain magnitude and better strain distribution uniformity. (2) The first pass ECAP process increases the mean hardness magnitude from 91 HV to 121 HV. (3) The hardness magnitudes and its standard deviations of ECAPed copper are (121 HV, 9.5) and (143 HV, 8.1) after one and four passes by route C as compared to the annealed state (91 HV, 4.8), respectively. This indicates that additional ECAP passes lead to higher hardness magnitude with better hardness distribution homogeneity. (4) Copper tube grain size measurement indicated that one and four passes of ECAP process reduce the grain size by about 50% and 70%, respectively. (5) Tube wall thickness variation measurement showed that ECAP process does not change the tube dimension (See F. Djavanroodi, A. A. Zolfaghari, M. Ebrahimi and K. M. Nikbin, *Acta Metall. Sin.* (*Engl. Lett.*), 2013, Vol. 26 No. 5 pp. 574-580). However, copper and titanium differ in mechanical properties and chemical properties.

ECAP (Equal Channel Angular Pressing) was recently tested as a method of improving the mechanical properties of titanium tubes. Cylindrical tubes made of commercially pure titanium (CP—Ti) filled with various mandrels (metallic as well as non-metallic materials) were processed by Equal Channel Angular Pressing (ECAP). Different temperatures (500° C. down to room temperature), tools and number of passes (1-6) were applied depending on the mandrel material. For reasons of comparison, solid bolts made of metallic mandrel materials were processed at the same ECAP conditions. The mechanical properties of as-received (AR), as well as ECAPed tubes and core materials, were characterized by hardness mappings (to reveal the homogeneity) and tensile tests. The results can be summarized as follows: i) It is feasible to process titanium tubes by ECAP; ii) Using appropriate mandrels, tubes made of CP—Ti can be processed by ECAP at significantly lower temperatures, even at room temperature, as compared to solid bolts; iii) Mechanical properties of tubes and mandrel materials after ECAP are similar to or even better than those of their solid counterparts; iv) Tubes after ECAP at the lower temperatures show higher strength than what can be achieved in bulk material; v) Excellent homogeneity of microhardness is achieved at least when metallic mandrels and a sufficient number of ECAP passes are used (See M. Krystian1, K. Bryła, J. Horky1, B, Mingler, IOP *Conf Series: Materials Science and Engineering,* 2017, v. 194, no 1, p. 012010). Yet Krystian et al discloses CP—Ti, CP—Al, Ti64, carbon, oak as the supporting mandrels, but does not disclose the use of polyurethane, which provides essential functional and economic advantages (below).

There is an unmet need for reliable industrial-scale manufacturing of titanium tubes of superior quality, conducted economically, at lower temperatures and, at flexible technological regimes. Accordingly, a manufacturing process using a polyurethane mandrel for ECAP applied to titanium tubing prototypes in ECAP processing is described herein.

BRIEF SUMMARY

According to the first aspect, the invention comprises equal channel angular pressing (ECAP) of titanium tubes, wherein a single ECAP die channel houses a tube supported by elastic polyurethane mandrel.

According to the second aspect, the angle of the die is 90 degrees and the tube is multiply re-processed by ECAP.

According to the third aspect, the re-processing is continued until the crystal structure of the resulting tube consists of a nanocrystal phase with the crystallite sizes of <100 nm.

According to the fourth aspect, the metal is pure CP-titanium.

According to the fifth aspect, the metal is a titanium alloy.

According to the sixth aspect, the process is implemented by the routes A, BA, BC and C (defined below).

According to the seventh aspect, the ECAP tube is slanted to compensate and control the strain.

According to the eighth aspect, the ECAP die channel forms multiple angles during a single run, wherein the angles can be equal or unequal.

According to the ninth aspect, methods of response surface and designed experiment (Box-Wilson multifactorial composition plans) are applied to identify the critical ranges of parameters.

According to the tenth aspect, mechanical properties are improved.

According to the eleventh aspect, heat conductance properties are improved.

According to the twelfth aspect, inhomogeneity of the properties along the length dimension of the tube is minimized.

According to the thirteenth aspect, the ECAP stage is integrated with the other methods of metallurgical processing such as annealing, rolling, pulling, extrusion and combinations in any order without limitation.

According to the fourteenth aspect, the thermal regime of the ECAP apparatus is regulated by the rate of compression, the presence of thermally conductive filler in the polyurethane, the length to cross-section aspect ratio, aspect ratio within the cross-section, distance of the working path from the cooling circuit, the overall scale of the apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings.

DETAILED DESCRIPTION

The present disclosure will be better understood with reference to the following definitions.

As used herein, the words "a" and "an" and the like carry the meaning of "one or more". Additionally, within the description of this disclosure, where a numerical limit or range is stated, the endpoints are included unless stated otherwise. Also, all values and subranges within a numerical limit or range are specifically included as if explicitly written out.

As used herein, the terms "optional" or "optionally" means that the subsequently described event(s) can or cannot occur or the subsequently described component(s) may or may not be present (e.g. 0 wt %).

As used herein, the term "tube" extends to all hollow metal items with an annulus bounded by continuous walls.

As used herein, the term "workpiece" extends to the entire assembly moving through an ECAP channel, which includes the hollow (typically tubular) item and the support.

Figure 1A:
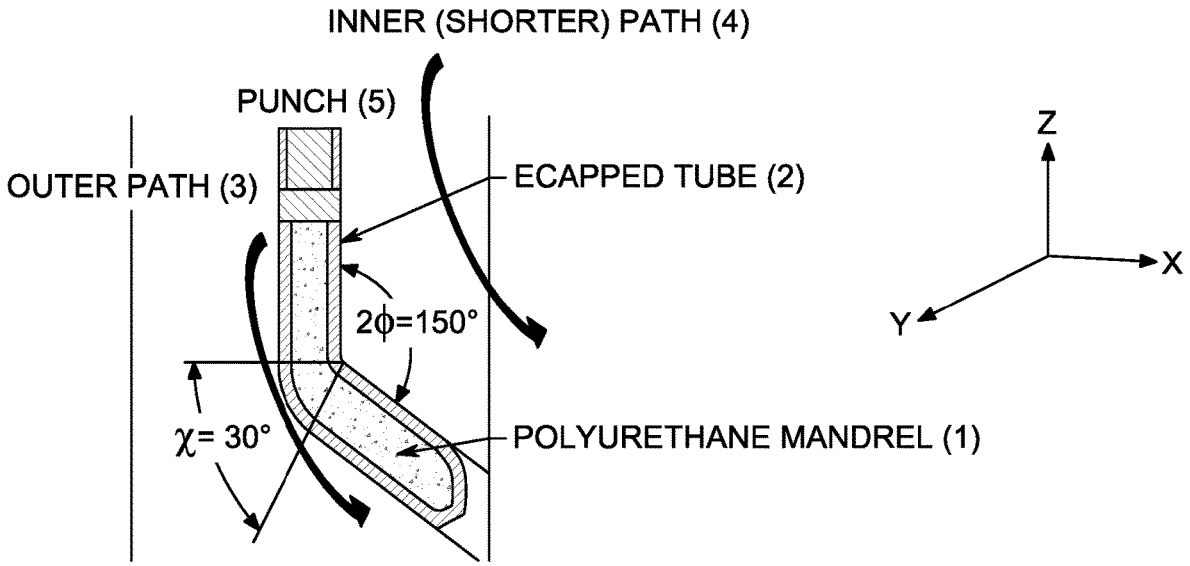
FIG. 1A shows a scheme of equal channel angular pressing of a titanium tube.

As used herein, "vertical direction" is the direction normal to the floor plane, shown as the axis Z in FIG. 1A.

As used herein, "vertical channel" or "input channel" is the upper ECAP half-channel before the knee/bending/turning angle region.

As used herein, the "horizontal plane" is parallel to the floor plane, shown as the X-Y in FIG. 1A.

As used herein, the "horizontal channel" or "output channel" is the lower ECAP half-channel past the knee/turning/bending angle region.

As used herein, the term "ECAP channel knee" or "turning angle" is the bending zone of transition between the vertical and horizontal parts of the channel, herein defined above.

As used herein, "finite element" is a voxel of the workpiece volume, with the volume negligible as compared to the entire item.

As used herein, the "outer path" or "outside path" or "longer path" is the length of the path that a finite element of a workpiece travels in the channel starting at the top vertical position up to the exit in the X-Y plane (path 3 in FIG. 1A).

As used herein, the "outside angle" is the angle on the outer/outside path of the channel.

As used herein, the "inner path", "inside path" or "shorter path" is the length of the path that a finite element of a workpiece travels in the channel starting at the top vertical position up to the exit in the X-Y plane (path 4 in FIG. 1A).

As used herein, the "inside angle" is the angle on the inside/inner path of the channel. As used herein, the term "punch" or "pusher" or "ram" refers to an adaptor conducting the pressure form the head of the hydraulic press to the workpiece in the ECAP channel.

As used herein, the term "hollow object" refers to an object with the unoccupied vacancy within its inner diameter, opening on the front and back faces of the object. The external diameter of the object can be lesser than the inner diameter of the ECAP channel.

As used herein, the term "mandrel" refers to the support conformally filling the vacancy within the hollow object as defined above. The vacancy between the outer diameter of the hollow object and the inner diameter of the ECAP channel is filled by the "outer support" material, distinct from the mandrel, which can be chemically the same or a different material.

Embodiments of the present disclosure will now be described more fully hereinafter with reference to the accompanying drawings, in which some, but not all of the embodiments of the disclosure are shown.

Figure 1B:
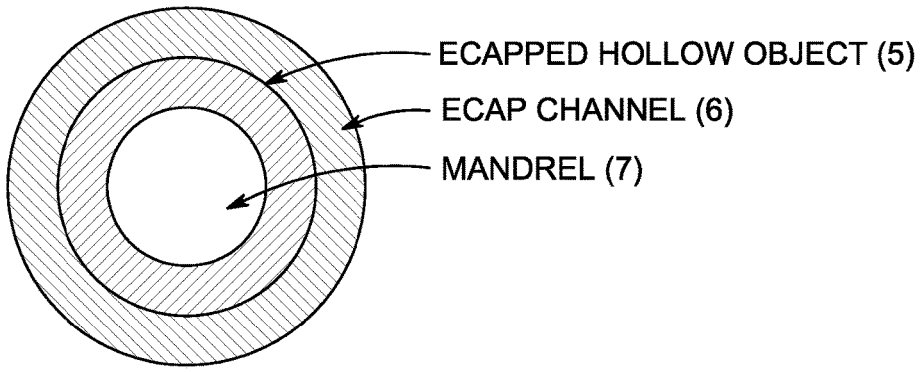
FIG. 1B shows cross sections of a round tube.
Figure 1C:
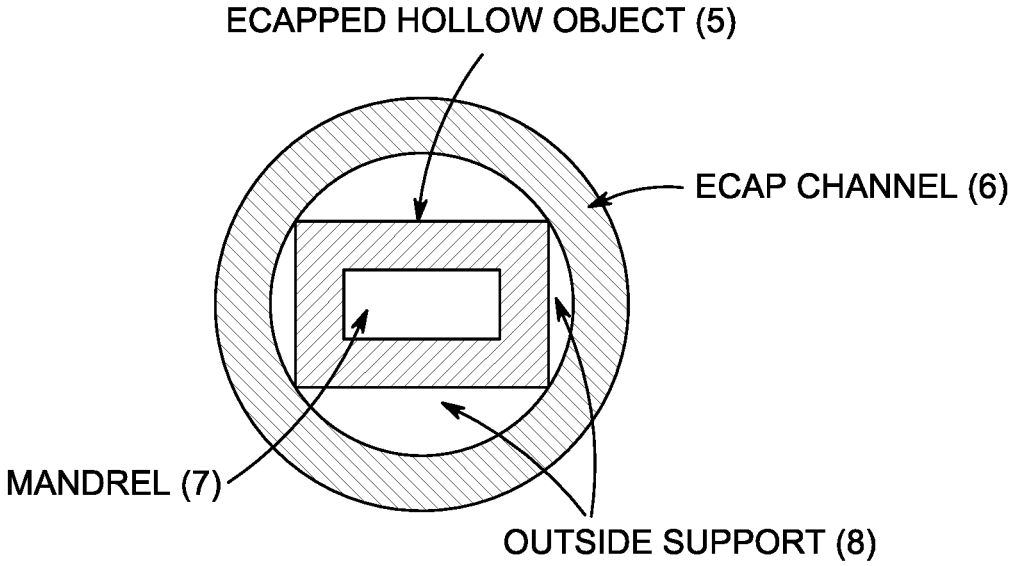
FIG. 1C shows a rectangular hollow workpiece.

FIG. 1 demonstrates the overall setting of the inventive ECAP process. The ECAP channel is provided (FIG. 1A, positions 1, 2), forming an L-shape or bent configuration at 150 degrees in this non-limiting illustration, with the outer path (position 3) and the inner path (position 4) and the corresponding outside and inside angles. The cylindrical channel is filled with the support sheath, exactly matching the inner diameter of the formed tube by the support's outer diameter (FIGS. 1B, 1C). In operation, the hollow workpiece is pushed starting at the initial position at the top of the vertical side of the die and through the angular/bent section until it emerges completely out of the horizontal side (in the direction of the arrow). During the movement, the metal elements experience a controlled high bending and plastic deformation, with the extent and direction of the deformation controlled by the pressure, process speed as well as the presence of support.

FIGS. 1B and 1C describe non-limiting embodiments of an ECAPed hollow workpiece, presenting the cross-sections of the apparatus in the bent region. The embodiment of FIG. 1B is the processing of a tube, with the external diameter of the tube's wall matching the internal diameter of the pressure channel. The embodiment of FIG. 1C illustrates a broader situation when the workpiece is of an arbitrary form and includes a hollow space and gaps between the inner surface of the cylindrical pressure channel and the outer surface of the workpiece (positions 5-8).

The ECAP process described herein is not limited to pure titanium, titanium alloys, or one specific metal. Chemically pure titanium is considered below only as an example without limiting the scope of the disclosure.

Commercially pure titanium (>99% Ti) is a low-to-moderate strength metal that is not well suited for aircraft structures or engines. The yield strength of high-purity titanium is within the range of 170-480 MPa, which is too low for heavily loaded aerostructures. The composition and properties of several commercially pure titanium alloys are given in Table 1.

In the USA, the commercially pure forms of titanium are classified according to the ASTM standard, although not all countries have adopted this system. The standard simply classifies the metal types according to a numbering system, e.g. Grade 1, Grade 2 and so on.

Pure titanium is rarely if ever, used in aircraft. However, one important engineering property of titanium is the ability to retain strength and ductility at low temperatures and therefore CP—Ti is useful for cryogenic applications. An aerospace application of commercially pure titanium is in fuel storage tanks containing liquid hydrogen for space vehicles. Liquid hydrogen must be stored below −210° C. under normal atmospheric conditions, at which temperature commercially pure titanium has good strength and toughness. Pure titanium has a hexagonal structure (space group P63/mmc, a=0.295 nm, c=0.468 nm at room temperature) at lower temperatures but transforms to the body-centered cubic structure at higher temperatures above 882° C. The hexagonal structure is denoted as the α phase, whereas the body-centered cubic structure is the β phase. The transformation temperature between a and β phases is strongly influenced by the presence of impurity or alloying elements. The substitutional element A1 and the interstitial elements such as O, N, and C dissolve preferentially in and expand the α phase. They can increase the α-to-β transformation temperature and therefore are strong α stabilizers. Other α stabilizers include B, Ga, Ge and RE (rare-earth elements). The β stabilizers are usually classified into two groups: those forming binary systems of the β isomorphous type and those favoring the formation of a β eutectoid. The β isomorphous elements include V, Mo, W, and Nb, and the additions of sufficient amounts of these elements can stabilize the β phase down to room temperature. The commonly used β eutectoid elements are Cr, Fe, and Si. Alloying elements such as Zr, Hf, and Sn do not cause much change to the α-to-β transformation temperature, and these elements have neutral effects on either α or β phase. Based on which phase is dominating the microstructure after processing, titanium alloys are classified into three main groups: α, α+β and β (See Z. Ahmad. *Principles of corrosion engineering and corrosion control. Chapter* 9 *titled "Selection of Materials for Corrosive Environment*"; Elsevier; 2006 Sep. 18, incorporated herein by reference in its entirety).

TABLE 1

Composition and tensile properties of commercially pure titanium alloys, maximum impurity limits (wt %).

| Type | N | C | H | Fe | O | Young's modulus (GPa) | 0.2% Yield strength (MPa) | Tensile strength (MPa) | Elongation (%) |
|---|---|---|---|---|---|---|---|---|---|
| ASTM Grade 1 | 0.03 | 0.10 | 0.015 | 0.20 | 0.18 | 103 | 170 | 240 | 25 |
| ASTM Grade 2 | 0.03 | 0.10 | 0.015 | 0.30 | 0.25 | 103 | 280 | 340 | 20 |
| ASTM Grade 3 | 0.05 | 0.10 | 0.015 | 0.30 | 0.35 | 103 | 380 | 450 | 18 |
| ASTM Grade 4 | 0.05 | 0.10 | 0.015 | 0.50 | 0.40 | 103 | 480 | 550 | 15 |

Table 1 shows that some grades of pure titanium have a tensile strength of more than 450 MPa, the value comparable with that of the aluminum alloys used in aircraft structures. However, the specific strength of pure titanium is not as high as the aluminum alloys because of its higher density. Commercially pure titanium contains a low concentration of impurities that remain in the metal after refining and processing from the rutile ore. Titanium contains trace amounts of impurities such as iron and atomic oxygen, and they have the beneficial effect of increasing strength and hardness by solid solution hardening. For example, ultra-high purity titanium (with an oxygen content of under 0.01%) has an ultimate tensile strength of about 250 MPa. In comparison, the ultimate strength of titanium with a small amount of oxygen (0.2-0.4%) is 300-450 MPa. However, it is not advantageous to strengthen titanium using impurity elements because there is a large loss in ductility, thermal stability and creep resistance. In one aspect of the present disclosure, it is this relative inferiority of the mechanical properties of non-alloyed pure titanium that motivates its metallurgical improvement by ECAP or a combination of methods incorporating ECAP.

The α-alloys contain predominantly α-phase at temperatures well above 540° C. (1000° F.). A major class of α-alloy is the unalloyed commercially pure (CP) titanium family of alloys that differ by the amount of oxygen and iron in each alloy. Alloys with higher interstitial content are higher in strength, hardness, and transformation temperature compared to high-purity metal. Other α-alloys contain additions such as aluminum and tin (e.g., Ti-5Al-2.5Sn and Ti-6Al-2Sn-4Zr-2Mo (in wt. %)). Generally, α-rich alloys are more resistant to high-temperature creep than α/β- or β-alloys, and α-alloys exhibit little strengthening from heat treatment. These alloys are usually annealed or recrystallized to remove stresses from cold working. They have good weldability and generally inferior forgeability in comparison to α/β- or β-alloys (See F. H. Froes, in *Encyclopedia of Materials; Science and Technology,* 2001, incorporated herein by reference in entirety). The beta alloys are readily heat-treatable, with increased hardenability compared with alpha or alpha-beta alloys. Though the room temperature strength of this alloy is high, its high-temperature strength is poor. Excellent formability can be expected of the beta alloys in the solution-treated condition. Examples of a few commercially available beta alloys include Ti-3Al-8V-6Cr-4Mo-4Zr, Ti-4.5Sn-6Zr-11.5Mo, Ti-8Mo-8V-2Fe-3Al, and Ti-13V-11Cr-3Al (See J. Dutta Majumdar, I. Manna, in *Laser Surface Engineering,* 2015, incorporated herein by reference in entirety). β-titanium alloys represent a versatile class of materials. While they offer the highest specific strengths, toughness and fracture resistance, they are limited by a small processing window and higher costs. Ti-13V-11Cr-3Al was the first commercially significant β alloy. Five popular alloys of this group today are the Timetal 21S, Beta C, Ti-10-2-3, BT 22 and Ti 17. The first four are used in structural applications and the last in gas turbines. Beta C is used for springs including return springs for brakes. Timetal 21S is a corrosion-resistant alloy that is resistant to hot hydraulic fluids (See I. Chattoraj, in Stress Corrosion Cracking, 2011, incorporated herein by reference in entirety).

Alpha-beta alloys have higher strength and respond to heat treatment, but they are less formable than alpha alloys. Fusion weld efficiencies up to 100% are attainable. This class of titanium alloys account for more than 70% of all commercially available. A few important alpha-beta alloys include Ti-3Al-2.5V, Ti-5Al-2Sn-2Zr-4Mo-4Cr (Ti-17), Ti-6Al-2Sn-2Zr-2Mo-2Cr-0.25 Si, Ti-6Al-2Sn-4Zr-6Mo, and Ti-6Al-6V-2Sn. (See J. Dutta Majumdar, I. Manna, in Laser Surface Engineering, 2015, incorporated herein by reference in entirety). α/β-Alloys contain one or more of the α- and β-stabilizers. These alloys retain more β-phase after final heat treatment than the near α-alloys and can be strengthened by solution treating and aging, although they are generally used in the annealed condition. Solution treatment is usually performed high in the α/β-phase field followed by aging at lower temperature to precipitate α-phase, giving a mixture of relatively coarse primary α- and fine α-phase in an α/β-matrix. Solution treating and aging can increase the strength of these alloys by up to 80%. Alloys with low amounts of β-stabilizer (e.g., Ti-6Al-4V (wt. %), alloy) have poor hardenability and must be rapidly quenched for subsequent strengthening. A water quench of Ti-6Al-4V will adequately harden sections only less than 25 mm (1 in). β-Stabilizers in α/β-alloys increase hardenability (See F. H. Froes, in Encyclopedia of Materials: Science and Technology, 2001, incorporated herein by reference in entirety). The comparative mechanical properties of titanium alloys and CP-Titanium are summarized in Table 2. (summarized 15 excerpts from ASTM B265-15 Standard Specification for Titanium and Titanium Alloy Strip, Sheet, and Plate, ASTM B348-13 Standard Specification for Titanium and Titanium Alloy Bars and Billets, ASTM B338-17e1 Standard Specification for Seamless and Welded Titanium and Titanium Alloy Tubes for Condensers and Heat Exchangers, ASTM B861-14 Standard Specification for Titanium and Titanium Alloy Seamless Pipe, incorporated herein by reference in entirety). The Table 2 illustrates the challenge of improving CP—Ti mechanical strength, while maximally preserving its cold ductility and heat conductance.

TABLE 2

Mechanical Properties of some Titanium Grades and Alloys

| | Tensile strength (min) | | 0.2% yield strength (min) | |
|---|---|---|---|---|
| Designation | MPa | ksi | MPa | ksi |
| Unalloyed grades | | | | |
| ASTM grade 1 | 240 | 35 | 170 | 25 |
| ASTM grade 2 | 340 | 50 | 280 | 40 |
| ASTM grade 3 | 450 | 65 | 380 | 55 |
| ASTM grade 4 | 550 | 80 | 480 | 70 |
| ASTM grade 7 | 340 | 50 | 280 | 40 |
| ASTM grade 11 | 240 | 35 | 170 | 25 |
| α and near-α alloys | | | | |
| Ti-0.3Mo-0.8Ni | 480 | 70 | 380 | 55 |
| Ti-5Al-2.5Sn | 790 | 115 | 760 | 110 |
| Ti-5Al-2.5Sn-ELI | 690 | 100 | 620 | 90 |
| Ti-8Al-1Mo-1V | 900 | 130 | 830 | 120 |
| Ti-6Al-2Sn-4Zr-2Mo | 900 | 130 | 830 | 120 |
| Ti-6Al-2Nb-1Ta-0.8Mo | 790 | 115 | 690 | 100 |
| Ti-2.25Al-11Sn-5Zr-1Mo | 1000 | 145 | 900 | 130 |
| Ti-5.8Al-4Sn-3.57Zr-0.7Nb-0.5Mo-0.35Si | 1030 | 149 | 910 | 132 |
| α-β alloys | | | | |
| Ti-6Al-4V(a) | 900 | 130 | 830 | 120 |
| Ti-6Al-4V-ELI(a) | 830 | 120 | 760 | 110 |
| Ti-6Al-6V-2Sn(a) | 1030 | 150 | 970 | 140 |
| Ti-8Mn(a) | 860 | 175 | 760 | 110 |
| Ti-7Al-4Mo(a) | 1030 | 150 | 970 | 140 |
| Ti-6Al-2Sn-4Zr-6Mo(b) | 1170 | 170 | 1100 | 160 |
| Ti-5Al-2Sn-2Zr-4Mo-4Cr(b)(c) | 1125 | 163 | 1055 | 153 |
| Ti-6Al-2Sn-2Zr-2Mo-2Cr(c) | 1030 | 150 | 970 | 140 |
| Ti-3Al-2.5V(d) | 620 | 90 | 520 | 75 |
| Ti-4Al-4Mo-2Sn-0.5Si | 1100 | 160 | 960 | 139 |
| β alloys | | | | |
| Ti-10V-2Fe-3Al(a)(c) | 1170 | 170 | 1100 | 160 |
| Ti-13V-11Cr-3Al(b) | 1170 | 170 | 1100 | 160 |
| Ti-8Mo-8V-2Fe-3Al(b)(c) | 1170 | 170 | 1100 | 160 |
| Ti-3Al-8V-6Cr-4Mo-4Zr(a)(c) | 900 | 130 | 830 | 120 |
| Ti-11.5Mo-6Zr-4.5Sn(a) | 690 | 100 | 620 | 90 |
| Ti-15V-3Cr-3Al-3Sn | 1000(b)<br>1241(f) | 145(b)<br>180(f) | 965(b)<br>1172(f) | 140(b)<br>170(f) |
| Ti-15Mo-3Al-2.7-Nb-0.2Si | 862 | 125 | 793 | 115 |

Titanium precursor pipes are produced form both CP-Titanium and the alloys. There are numerous suppliers of tubing, with the non-limiting list including Performance Titanium Group, San Diego, Calif.; Express Metals Co., Camarillo, Calif.; Ferralloy Inc, Cleveland Ohio; Ulbrich Stainless Steels & Special Metals Inc, North Haven, Conn.; Metalmen Sales Inc., Long Island City, N.Y.; Superior Tube Company, Collegeville, Pa.; FD Titanium, Zhangjiagang Zhongke Tube Industry Co., Ltd. Additionally: Thomasnet lists 202 suppliers. IQS Directory lists multiple suppliers located in the USA territory. A catalog of >30000 China-manufactured titanium tube products is available in Hot China Products online catalog in the "titanium tubes" category. The rankings of the suppliers and more detailed US-based lists are available in Industry.net online catalog. To increase ductility, the tubular precursor is pre-processed before ECAP by rolling or/and annealing, typically by the manufacturers and the suppliers, the annealing temperatures are typically in the range 200-500° C. While stronger titanium alloys can present ductility issues, CP—Ti is a naturally ductile metal and the disintegration under high pressure is comparatively a lesser concern for this material. ASTM E290-14 (Standard Test Methods for Bend Testing of Material for Ductility) are applicable to titanium alloyed and un-alloyed items according to ASTM B265-15 (Standard Specification for Titanium and Titanium Alloy Strip, Sheet, and Plate).

Bend formability values are expressed by the ratio of the minimum bend radius (MBR) divided by the thickness (t) of the material, MBR/t. Test procedures for measuring bend formability can be found in ASTM E 290 and B 820. A simple test for bend formability in titanium wire is the "Wrap Test." In this test, wire is bent around its own thickness many times. This allows examination of the bend over a long length and for most wire shapes is a MBR/t value of 0.5, a relatively sharp bend. In wire form, most titanium alloys will pass this test. In the preferred embodiments, the annealed wire intended for ECAP is annealed at 500° C. until MBR/t<1.5, preferably <1.0, even more preferably <0.5. If wire made of a given titanium-based material passes formability test it is suitable for ECAP of any geometrical shapes. Three-point bending test for other geometries are exemplified in U.S. Pat. No. 5,230,348A and incorporated herein by reference.

ECAP supports include sands (dispersed hard non-compressible particles), wood, coal, metals or rubber-like elastomers such as rubbers per se or rigid polyurethane elastomers. Each subclass is presented as a non-limiting example only and numerous embodiments are possible within each sub-group to be considered below. One preferred and non-limiting embodiment are polyurethanes. Typically, polyurethanes are produced by copolymerization of isocyanates and polyols. Polyurethane is a polymer of the repeat unit structure (—$R^1$—NH—C(=O)—O—$R^2$—), where $R^1$ and $R^2$ can be the same or different, thermoplastic or thermoset, linear or branched, derivatized or unmodified, saturated or unsaturated, low or high molecular weight. The persons skilled in the art recognize that not all polyurethanes are suitable for the function of supports and mandrels. However, polyurethane rubbers can be successful supports (See F. Djavanroodi, A. A. Zolfaghari, M. Ebrahimi and K. M. Nikbin, *Acta Metallurgica Sinica* (*English Letters*). 2013, 26(5), 574-80; F. Al-Mufadi and F. Djavanroodi, *Arabian Journal for Science and Engineering,* 2015, 40(9), 2785-94; F. Djavanroodi, A. A, Zolfaghari, M. Ebrahimi, K. Nikbin, *Acta Metallurgica Sinica* (*English Letters*), 2014, 27(1), 95-100), incorporated herein by reference in entirety. The non-limiting preferred embodiments are hard polyurethanes co-polymerized with elastomers.

One preferred group of components are hydroxyl-terminated polyester or high molecular weight polyether (600 to 4000 Da) diols or mixtures thereof. Examples of polyethers are poly(oxypropylene) diols and poly(oxytetramethylene) diols. Examples of polyesters are adipates, polycaprolactones, and aliphatic polycarbonates. The diols are co-polymerized with a chain extender: this is a low molecular weight (61 to 400 Da) diol such as ethylene glycol, 1,4-butanediol, 1,6-hexanediol or hydroquinone bis (2-hydroxyethyl) without limitation. The extended diols are polymerized with a bulky polyisocyanate (mostly a diisocyanate), the most popular one being diphenylmethane-4,4-diisocyanate (MDI). Others are hexamethylene diisocyanate (HDI) or 3,3'-dimethyl-4,4'-biphenyl diisocyante (TODI) (see WO18015173A1, incorporated herein by reference in entirety).

Other non-limiting embodiments of hard polyurethane with elastomeric properties are exemplified by EP1964866 Bi, incorporated herein by reference in entirety. The publication discloses a process for producing pore-free thermoplastic polyurethane elastomer moldings having a Shore D hardness in accordance with DIN 53505 of 60 or more, in which polymeric diols and chain extenders are mixed with isocyanate and optionally catalysts, reactive chain extenders, and the other additives to form a reaction mixture, this is introduced into a mold and cured to form the polyurethane elastomer. In this process, the reactive chain extender is a linear polyether based on propylene oxide (or butanediol), and having two primary amino groups and a molecular weight in the range from 100 to 500 g/mol. wherein the weight ratio of polymeric diol to chain extender is in the range from 70:30 to 40:60. The polymeric diol of this process is polytetrahydrofuran having a number average molecular weight of from 200 to 2500 g/mol, while the isocyanate is diphenylmethane diisocyanate (diphenylmethane 4,4'-diisocyanate) wherein the emulsifier is an alkoxyethylene glycol ether of the general formula RO(CH2-CH2-O)xH where R is a linear or branched or cyclic alkyl radical having from 5 to 20 carbon atoms and x is an integer from 3 to 15. In a still another embodiment, the publications WO9324549A1, U.S. Pat. No. 5,325,612A, JP4001218A, JP57207037A also disclose hard polyurethane elastomers.

In a non-limiting preferred embodiment, the polyurethane is thermostable, defined as tolerating the temperatures>200 C without decomposition. A new generation of polyurethane thermoplastic thermostable elastomers was synthesized via the reaction of NCO-terminated polyurethane with 2,2'-pyromellitdiimidodisuccinic anhydride chain extender (see H. Y. Mohammad and A. Shamekhi, Polymer, 2004, Volume 45, Issue 2, Pages 359-365, incorporated herein by reference in entirety). In another non-limiting embodiment, a continuous process for producing a thermally stable thermoplastic polyurethane elastomer is incorporated herein by reference in entirety (see U.S. Pat. No. 6,624,278), comprising: A) obtaining a reaction mixture that includes as reactants (i) at least one substantially linear hydroxyl-terminated polyol having a number average molecular weight of 600 to 5000, and (ii) an amount of at least one organic diisocyanate, and (iii) a chain lengthening agent having a molecular weight of 62 to 500, wherein NCO to OH ratio of all reactants including acid H compounds is in the range of 0.9:1 to 1.2:1, said amount of diisocyanate established to result in the maximum melt viscosity of the reaction product prepared from (i), (ii) and (iii), and B) adding to said reaction mixture at least one acid H compound in an amount of 0.3 to 6 mol. percent, relative to the amount of the chain-lengthening agent, sufficient to result in an elastomer having a constant melt viscosity that is at most 90 percent of said maximum. Other non-liming embodiments of thermo-resistant polyurethane elastomers incorporated herein by reference in entirety are in U.S. Pat. Nos. 5,064,875A, 5,093,379A, JP3100051A, JP3100050A, JP3100050A, EP0224945A1, U.S. Pat. No. 4,629,768A.

Regarding the polyurethane composition and proportions, another preferred illustrative embodiment includes polyurethanes that were specifically tested in the production of hollow metal objects. These polyurethanes are tabulated in the reference F. Djavanroodi, M. Daneshtalab and M. Ebrahimi, *Mater. Sci. Eng. A,* 2012, 535, 115-121, incorporated herein by reference in entirety, including mechanical properties.

In yet another non-limiting and preferred embodiment, the hollow object intended to be processed by ECAP is already inserted in a pre-set mold. The polyurethane reaction mix fills the tubular inner volume under the conditions of room temperature or lower (to prevent a premature reaction). After filling all interstices, the mold is cured at the process temperature regime (200° C.), inducing polymerization, while simultaneously annealing the tubular prototype. The advantage of this embodiment is to avoid machining of hard polyurethane elastomer for each batch. The ECAP prototypes achieve perfect fit with the molds. The ECAP workpieces of interest can be flexibly pre-set and such process can be automated. In another modification of this embodiment, the metallic elements are placeholders and are removed after curing and cooling, producing the customized mandrels for the insertion in the real tubular annealed prototype for processing. In yet another and preferred embodiment, the cross-sections of the prototype hollow objects in the pre-form can be made to be of any arbitrary shape, not necessary annular shape, for example, and without limitation: hollow triangular, hollow rectangular, hollow oval, hollow undulated, hollow screw-shaped, hollow star-shaped, etc. (FIGS. 1B and 1C). With these shapes and pre-forming, the polyurethane support can be introduced in the spaces within and outside of the hollow metal item, providing the internal and external support (FIG. 1C). Thus, a more versatile set of hollow metal parts can be processed. Matching the metal part and mandrel is not manual, but can be conducted with the industrial-scale productivity in this embodiment.

Another preferred embodiment is to incorporate fillers in the polyurethane base and modify the bulk properties by the presence of the fillers. The preferred filler embodiments are inert inorganic particles that behave in a sand-like manner but exceed sand in thermal conductivity and serve better under the conditions of intense heat evolution that may be rate-limiting in the overall process. Such extensive heat production is expected in ECAP treatment of thick-walled items, intended as cylinders to house chemical reactions, major oil and gas transit piping, drilling piping to line the formation boreholes.

Non-limiting examples of thermo-conductive fillers are graphite, refractory metal chips and powder (metallurgical waste and cuttings), $MoS_2$ powder, H13 steel dust cutting, stainless steel powder and cuttings, elemental titanium powder and cuttings. While chemical reactivity and contamination of the pure titanium surface by non-titanium elements is a concern at higher temperatures, the temperature control is greatly facilitated by highly thermo-conductive support, without the risk of the support overheating and overall sub-optimal product quality during the attempts to increase the installation productivity.

Especially preferred embodiments are stainless steel and H13 steel powder cuttings, balancing low price, relative inertness in terms of being titanium contamination and the possibility of chelator leaching of the finished item to remove non-titanium penetrants. An even more preferred embodiment is pure titanium cuttings (of cheaper grades), with the proviso that the combination of maximal temperature and pressure does not cause compaction and sintering of the particles in the channel bend region. High thermal conductivity of titanium particles and non-contamination of the final product indicates a preferred support filler in some regimes.

Still another preferred embodiment are copper cuttings and dust fillers. Compared to titanium, these materials have 23-fold higher heat conductivity vs. CP—Ti and even greater ratio as compared to the strengthened Ti alloys. (>500 W/m×sec for copper, 17 W/m×sec for Cp-Ti, 6-12 W/m×sec for the Ti alloys). Highly thermo-conductive mandrel would contribute to rapid heat dissipation from the bend region, where the most of deformation work and waste heat release takes place. The heat can propagate longitudinally and reach a higher surface of heat-transfer over a shorter time. Because conductivity heat transfer step is the limiting in the overall sequence, the overall productivity of the ECAP installation can increase, provided that the surface of the titanium tube is not contaminated by copper powder, capable of producing potentially corrosive galvanic pairs due to its greater electrochemical potential. This cross-contamination problem can be solved by controlling the copper filler content in the polyurethane mix, sand polishing the titanium tube after processing, subjecting the ECAP-ed tubes to the downstream steps removing the contaminated surface layer such as extrusion through an annular die. In still another variation the filler can be aluminum, but this metal may react with the acidic components of the polymerization mix at higher temperature. The optimal regimes can be established by routine experimentation.

Yet even more preferred embodiment is a combination of titanium chip/powder waste particles and sand particulates with the average diameter smaller than the titanium particles at the mass ratio titanium to sand 2:1 as a filler. At this ratio, the smaller sand particulates fill the interstices between the bigger metal particles and inhibit compaction or sintering while thermal conductivity is elevated significantly, while the metal-to-metal contacts are minimized. In another very preferred embodiment, the titanium powder can be added to the polyurethane reaction mix as fillers before curing at 50-70% of the total mass, producing a composition more thermally stable and heat-conductive than pure polyurethane and less prone to compaction than pure metal powder. Sufficient homogenization (in the absence of curing catalyst) ensures that the metal powder and polyurethane reaction mix are intimately mixed and no metal powder aggregates form before curing and polymerization.

It is apparent to a person skilled in the art that non-filled polyurethanes would lead to a successful product of good quality without a post-processing step but the absence of a heat-conductive filler limits both the cross-section, pressure, and processing speed in the die due to heat evolution destructive to the quality of the final product. The polyurethanes with pure titanium particulate filler lack this drawback but introduce the problem of sintering and compaction. A composite titanium-polyurethane or titanium-sand-polyurethane fillers may be optimized to ensure the maximal hourly production by the ECAP pressing at the minimal restoration and post-processing of the final product. Other metal fillers in the polyurethane mandrel—such as copper or aluminum may offer stronger heat-management properties, but introduce the trade-off mentioned above.

ECAP installation consists of a hydraulic press, channel die, cooling system, and sensors. The hydraulic presses suitable for ECAP provide a combination of high pressure, even load distribution in the X-Y plane and a constant (controllable) rate of forward propagation of the workpiece in the die channel.

Theoretical models and force diagrams guiding the required parameters of a hydraulic press are disclosed in N. A. Anjum, M. Shah, S. Mehmood, W. Anwar, S. Anjum, M. S. Khalil, *Technical Journal, University of Engineering and Technology* (*UET*) *Taxila*, Pakistan, 2017, Vol. 22, No. II-2017, incorporated herein by reference in entirety. Hydraulic power systems were designed according to the requirements of ECAP. The principal designing parameters included the piston stroke, maximum load, cylinder bore, volume flow rate of the working fluid and system pressure. The important designing components include hydraulic cylinder, hydraulic circuit and main structure of the system (frame). The pressing load was calculated for ASTM AISI H13 tool steel that is being used in ECAP die manufacturing. The flow stress of the material is 35 MPa and the surface friction is considered as 0.3, because a very high contact pressure develops between the die walls and workpiece. ECAP die is composed of two channels and these channels are divided into three regimes 1, 2, and 3 for calculating the speed and load (regime 1 is in the vertical part of the die, regime 2 is in the turning region, regime 3 is in the X-Y plane). The analysis allows translating the requirements of extrusion to the tons of hydraulic pressure, with the upper limit of 100 tons. In alternative embodiments, the match between the press and the needs of the process can be achieved by empirical calibration, by scaling up the size of the die and observing the increase in the pressure, until it begins to approach the limits for the given hydraulic press. The presses are produced by a wide group of machinery manufacturers such as Press Master, Baileigh Hydraulic Presses, Neff Press, OMERA, Version Hydraulic Presses, Enerpac, Abexmatic Hydraulic, Beckwood Press, Simplex, Phoenix Presses (can be custom manufactured), Wabash Hydraulic Presses (custom manufactured, 100-200 tons), ETK International, Carver Hydraulic Presses, Pacific Experts (custom manufacturing), Magnum Press, Amob Group, Profi Press, Jet Tools, Smith & Associates, Sacmi Iberica, Technopres, Icon Industries and others known to the skilled in the art and incorporated herein by reference in entirety and without limitation.

Values of the ECAP process were established experimentally. In general, the pressure can vary as a function of extrusion constant, which in turn depends on the size of the hollow object, the ratio of wall thickness to the hollow object diameter, the materials of the hollow object and the supporting mandrel, the temperature of the hollow object and the mandrel defining plasticity. A preferred range of pressures is between 1 and 100 tons, preferably 5-80 tons, 10-70 tons, 15-60 tons, or about 25-50 tons (See S. Venkatakrishnan, S. Shruthi, S. Raghuraman, and R. Venkatraman, 2016, *International Journal of Innovative Research in Science, Engineering and Technology*, Vol. 5, Issue 3; S. Tekeli, and A. Güral, *AIP Conference Proceedings,* 2011, 1415, 214; R. Lapovok, *Russian Metallurgy* (*Metally*), 2004, 1, 36-41; incorporated herein by reference in entirety). The die was designed to process a billet with the size of 5-50×5-50×25-500 mm, preferably 10-25×10-25×50-250 mm, or about 12.7×12.7×102 mm; preferably functioning at temperatures up to 400° C., preferably 50-400° C., 100-300° C. or about 150-250° C.; the load applied to press the billet inside the die can be varied, but is preferably 0.1-2.0 tons/cm$^2$, 0.5-1.5 tons/cm$^2$, about 1.0 tons/cm$^2$, or not greater than 1.5 tons/cm$^2$; and the pressing speed is preferably kept constant during the deformation; preferably a pressing speed of 0.1-5.0 mm/s, 0.5-2.5 mm/s, 1.0-2.0 mm/s or about 0.5-1.5 mm/s (See Grigoreta Mihaela Stoica, Doctoral Dissertation titled "Equal-Channel-Angular Processing (ECAP) of Materials: Experiment and Theory", 2007, The University of Tennessee, Knoxville). For the non-limiting example of a typical process, tubular objects with 1 cm wall thickness, ~20 cm external diameter, and with easily deformable mandrels, the maximum pressure is <100 tons and is within the ranges achievable on the standard hydraulic presses.

Figure 2:
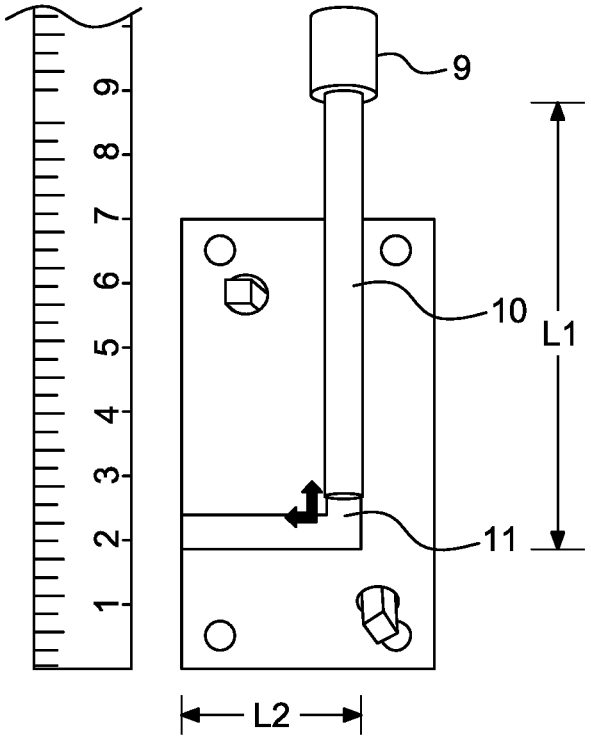
FIG. 2 shows a punch arrangement for an ECAP channel at 90 degrees.

Punch (pusher) is another crucial component of the ECAP process serving as the mediator between the force created by the press and the workpiece. It is a hard adaptor shaped to connect the pressing surface and the upper surface of the workpiece assembly, fitting precisely to the latter. Gaps between the punch and workpiece as well as between the channel walls and workpiece are problematic, directing the material—including the supporting mandrel—to bulge and flow in the gaps, thus leading to wavering, wrinkling and bending of the processed items and inducing a sub-optimal microstructure. FIG. 2 illustrates a typical punch arrangement. The position 9 indicates the head of a hydraulic press and the position 10 indicates the adaptor (punch, pusher) inserted in the head and precisely matching the ECAP channel in diameter, with the vertical side length L1. The position 11 is the horizontal part of the ECAP of the length L2 (importantly L1>L2). In operation, the head of the press propels the adaptor in the ECAP channels which in turn propels the workpiece. Upon reaching the turning part (regime 2, in the regions proximal to the position 11 of FIG. 2 and marked by a white angled double arrow), the assembly begins to bend and experience dramatic shearing forces as well as plastic deformation (see below), thereby re-organizing the microstructure of the metal. When the punch reaches the bottom of the vertical side of the die channel, the workpiece is displaced to the horizontal side of the channel and because L1>L2, a part of the assembly is protruding outside of the apparatus. The protruding side can be used to extract the entire workpiece from the ECAP die by the tools well known to the skilled in the art. The extraction is facilitated by dry lubrication of the walls by molybdenum disulfide, forming sliding platelets under the pressure.

In another embodiment, the initial workpiece (#1) is not extracted from the horizontal side of the die channel. Instead, the next workpiece (#2) is loaded in the vertical side and proceeds displacing the workpiece (#1). The advantage of this embodiment is the absence of a separate step of pulling out the finally processed workpiece, making the process un-interrupted under the proviso that cooling is efficient. This element is also important in upgrading the ECAP process to the industrial scale.

The ECAP die is the central element of the technology. Process modeling of equal channel angular pressing for ultrafine grained materials is disclosed (See H. S. Kim, P. Quang, M. H. Seo, S. I. Hong, K. H. Baik, H. R. Lee and D. Minh, *Materials Transactions,* 2004, Vol. 45, No. 7, pp. 2172 to 2176), incorporated herein by reference in entirety. There are two controllable parameters in geometric factors in ECAP; i) die geometry which was well investigated both experimentally and theoretically using analytical and numerical methods and ii) workpiece geometry. The most widely controlled geometric parameters are the channel angle $\Phi$ and the corner angle $\Psi$ of ECAP dies (FIG. 1A). Other critical parameters are back-pressure and friction, impacting temperature profile and plasticity of the metal. Additional theoretical treatments linking the geometry of the die to the outcomes (deformation, shape, temperature, residual strain) in the given workpiece are provided below without limiting and are incorporated herein by reference in entirety (See F. Djavanroodi and M. Ebrahimi, *Materials Science and Engineering: A,* 2010, 527(4-5), 1230-5; J. W. Park and J. Y. Suh, *Metallurgical and Materials Transactions A.* 2001, 32(12), 3007; T. Suo, Y. Li, Y. Guo and Y. Liu, *Materials Science and Engineering: A.* 2006, 432(1-2), 269-74; R. Z. Valiev and T. G. Langdon, *Reviews on Advanced Materials Science,* 2006, 13(1), 15-26; F. Djavanroodi and M. Ebrahimi, *Materials Science and Engineering: A,* 2010, 527(29-30), 7593-9; T. Suo, Y. Li, Y. Guo and Y. Liu, *Materials Science and Engineering: A.* 2006, 432(1-2), 269-74).

Despite abundant theoretical treatments, ECAP remains an empirical branch of technology, confined mostly to the research stage due to the complexity of its factor space. The metallurgical properties of the die channel and punch are among the important contributions in this complexity. The die channel material should be hard at elevated temperatures (which can reach 200-700 degrees C., see KR100415346B), not prone to plastic deformations over multiple cycles, fatigue and crack resistant. This balance of hardness and elasticity is reached in a few alloys, typically used in other metal extrusion die apparatuses. The suitable alloys for ECAP are named below, being mostly steels with the balance of hardness, elasticity and ductility encoded by the alloy's type and number. However, the requirements of ECAP are more strenuous, due to multiple runs of the same workpiece through the processing cycle and higher strains (see examples below). Deformations or cracks in the channel and the punch (pressure adaptor) would produce heterogenous sub-standard batches of the products with distorted geometry and inferior microstructure, unlikely to be commercially competitive.

The material suitable for ECAP dies are mostly hard steels (termed "die steels") such as H13 tool steel (See U.S. Pat. No. 9,468,960), chromium12 series cold-forming die steel and M2 high-speed steel (See CN1876880A), PGI Supports Tool & Die Shops (without limitation) provides customized dies made of A2, D2, S7, H13 tool steels. The exact choice of die steel relies on the management of temperature regime during the extrusion process, which in turn depends on the intensity of heat removal and the choice of a cooling system (water, oil, air, convective, evaporative without limiting).

The cold-work tool steels include the O series (oil-hardening), the A-series (air-hardening), and the D-series (high carbon-chromium). These are steels used to cut or form materials that are at low temperatures, being the least suitable for ECAP broad range of parameters. The D-series of the cold-work class of tool steels, which originally included types D2, D3, D6, and D7, contains between 10% and 13% chromium (which is unusually high). These steels retain their hardness up to a temperature of 425° C. (797° F.). Common applications for these tool steels include forging dies, die-casting die blocks, and drawing dies, making them more suitable for ECAP, but would require a more rigid temperature control than the hot work die steels.

Hot-working steels are a group of steel used to cut or shape material at high temperatures and are the most suitable for ECAP channel machining. H-group tool steels were developed for strength and hardness during prolonged exposure to elevated temperatures. These tool steels are low carbon and moderate to high alloy that provides good hot hardness and toughness and fair wear resistance due to a substantial amount of carbide. H1 to H19 is based on a chromium content of 5%; H20 to H39 is based on a tungsten content of 9-18% and a chromium content of 3-4%; H40 to H59 is molybdenum based. Other materials useful in servicing the ECAP dies are specialty steels, specifically L-group.

The embodiments of this invention are not limited to the special steels. Superalloys for turbine and rocket construction retain hardness and fatigue resistance at higher temperatures and working pressures, allowing machining of bigger diameter pipes with the thicker walls, not suitable for steel dies. International Molibdenum Association presents extrusion presses for extrusion, which requires 3000-4000 tons of pressure at 1000 C pre-heating. Such parameters are beyond the limits of iron-based materials (melting temperatures in the range 1400-1500 C) and molybdenum MHC alloy (99% of molybdenum) is required for these regimes. The alloy has excellent thermal conductivity, low thermal expansion, both reducing thermal stresses. Importantly, MHC alloy has much greater strength at these temperature ranges of the process and a preferred embodiment for large scale processing of thick-wall items by ECAP with fine sand mandrels (0% polyurethane).

High temperatures range (e.g., above the deformation or glass transition temperatures of the polyurethane materials, for example >200° C.) are not preferred since the use of polyurethanes as supporting mandrels is limited to about 150-200° C. at the upper range. Polyurethanes decompose at the temperatures above, often evolving hazardous products. Yet, superalloy dies are still more reliable than steel dies even at these lower temperatures<200° C., leading to the production of consistently standard batches. For thick-wall pipes, especially made of less ductile hardened titanium alloys, the extrusion constants for the entire assembly are high and would require working pressures in the ranges that challenge steel materials, especially in multiple ECAP cycles. Heat evolution for such items needs to be managed by the slow rate of puncher insertion and sand-metal fillers in polyurethane. Thus, superalloy use for ECAP dies is a preferred embodiment from the overall productivity and economy perspectives, due to a superior dimension range of the products and consistency of quality.

The temperature control means, associated heat-transfer, and heat-exchange means are essential for the process. Rising of temperature above a critical level would melt, decompose, or just severely weaken the organic polymer such as rubber or polyurethane. With the elasticity and integrity of the support elements in the ECAP channel turn compromised, the final product quality is not warranted. A composite produced by adding 50% of pure titanium particulate and 20% of fine sand fillers to 30% of polyurethane reaction mixes would produce a possible technical solution to overheating problem in the support mandrels and sheaths, allowing increased die volumes, pressures, processing speeds, increased diameters of the tube pre-cursors and shorter time between individual ECAP cycles (below). This intensification of the overall process is essential considering the movement of the ECAP technology to the level of industrial production by overcoming the existing challenges that confine it mostly to the laboratories.

With the problem of extracting waste process heat from the core of the ECAP channel (a rate-limiting step of the overall heat transfer), absorption and removal of this heat by a cooling jacket built in the die's wall is relatively trivial. The cooling jacket can envelop the die from the outside, with the entire thickness of the die wall serving as a heat-conducting medium. In an alternative embodiment, the cooling pipes may be installed in the die wall, with the overall strength of the construct calculated to accommodate the weakening taking place due to the presence of the internal cooling piping. In this context using expensive superalloys and producing long-lasting although more expensive die installation may be a preferred embodiment. Alternatively, using cheaper thinner dies may be conducive to support externally enveloping cooling jackets.

The heat-exchange jacket is operated by pumping coolant through the piping. The coolants are typical and well-known to the skilled in the art, with non-limiting examples of cold water, cooled water-alcohol mix (down to −40° C.), cold gas flow, evaporative organic solvents. The heat transfer process is not limited by the heat transfer coefficients on the boundary between the coolant and the pipe, or within the pipe wall. Rather, the rate-limiting stages are in the bulk of the die channel wall and/or in the bulk of the support mandrel. Thus, the choice of the coolant is less essential than minimization of the heat transfer resistance at the rate-limiting steps as was discussed above.

Figures 3A, 3B, 3C, 3D:
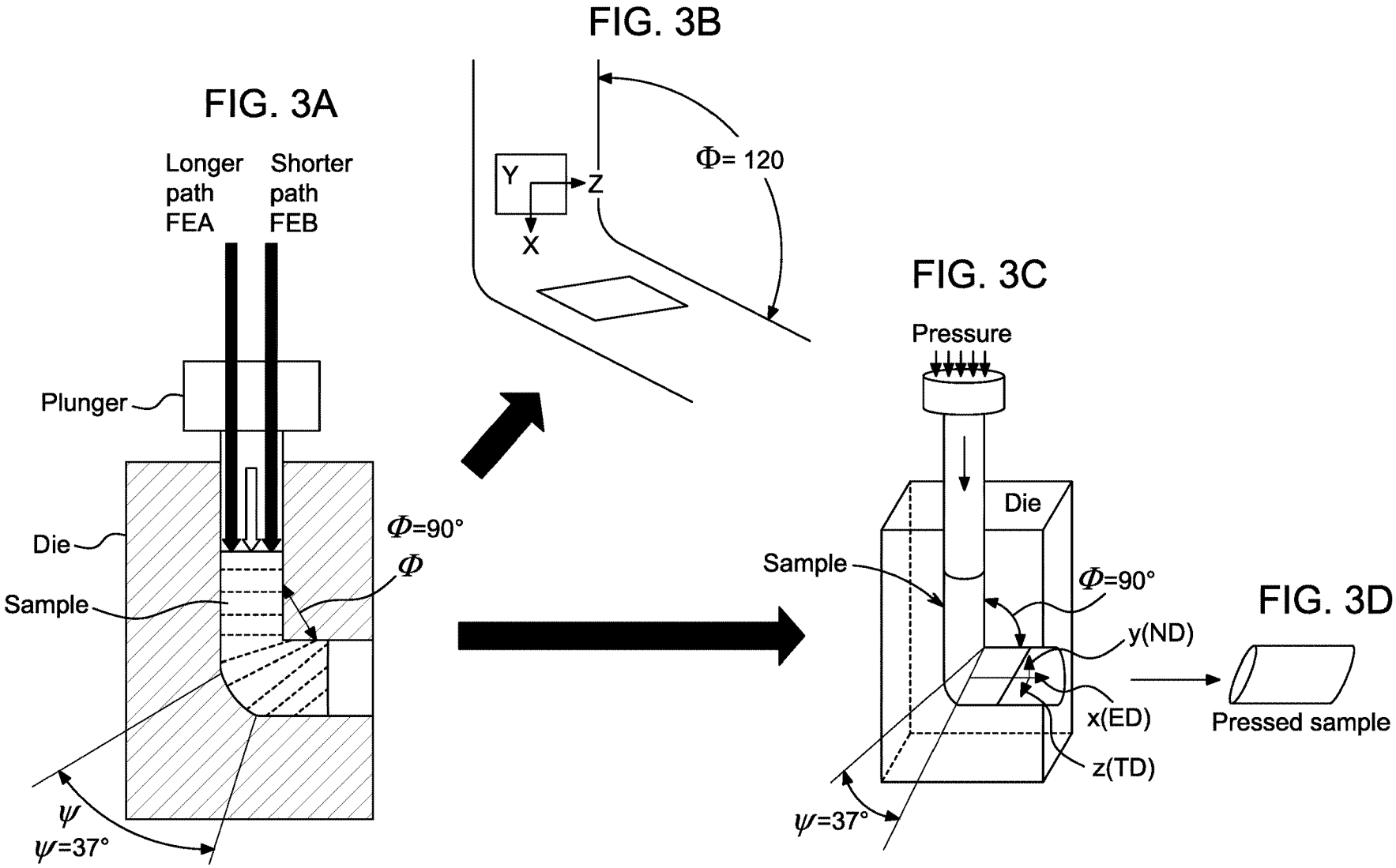
FIG. 3A shows a scheme of deformation evolution in the ECAP channel as a function of the extrusion process with inner and outer paths.
FIG. 3B shows a scheme of the ECAP channel with X-Y planes.
FIG. 3C shows a scheme of deformation evolution in the ECAP channel as a function of the extrusion process with a 90° turn.
FIG. 3D shows a processed part.

FIG. 3A-D indicates that the ECAP path of a finite metal element differs based on its initial position in the apparatus, taking an "outer path" or an "inner path" as shown in FIGS. 1A-C and 3A-C. In FIG. 3A the elements are designated as Finite Element A (FEA), moving by an outer path and Finite Element B (FEB), moving by an inner path. Another parameter of importance is the angle of die turning on each of the sides (inner or outer), which can be smoothed or rounded or can be a sharp 90-degree turn (FIG. 3C). The angles are assumed to be of 90 degrees on both sides. With equal forces acting on each finite element and equal resistance, the deformation work is proportional to the covered trajectory on both inner and outer sides. To produce equal covered trajectories, the finite elements being initially in the same X-Y plane at the top of the die channel emerge in different X-Y planes with a slanted connecting cross-section (FIG. 3B). Such a deformation incorporates a residual strain in the processed part (FIG. 3D), the strain being proportional to the cross-section diameter of the tube.

The presence of the "frozen-in" structural strain increases the free energy of the workpiece and leads to a microstructure re-organization minimizing this increase. In some cases, the strained reorganized microstructure may even be superior in its mechanical and heat-conductive parameters than a completely relaxed annealed prototype control. Thus, the quantity of the residual strain and the pattern of its accumulation (or relaxation) between multiple individual ECAP runs may be a process parameter.

Figure 4A:
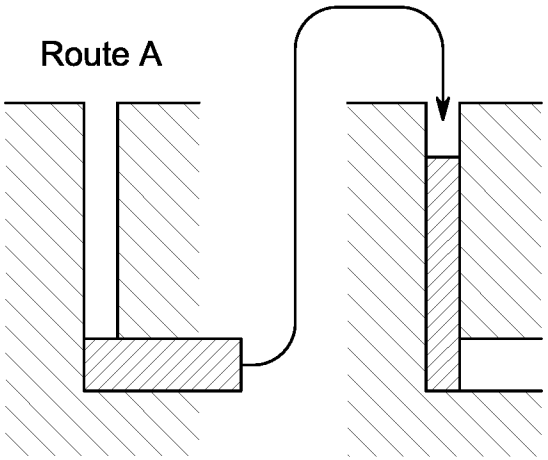
FIG. 4A shows a scheme of workpiece (tube) rotation between the individual ECAP passes in a multi-pass process in which strain accumulates between repeated passes.
Figure 4B:
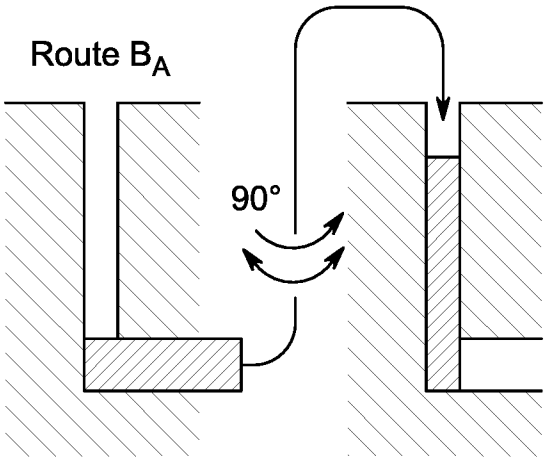
FIG. 4B shows a scheme of workpiece (tube) rotation between the individual ECAP passes in a multi-pass process including clockwise and counterclockwise turns.
Figure 4C:
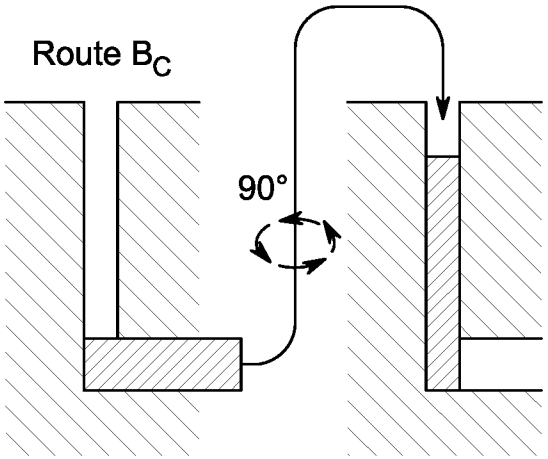
FIG. 4C shows a scheme of workpiece (tube) rotation between the individual ECAP passes in a multi-pass process including re-insertion and clockwise turns.
Figure 4D:
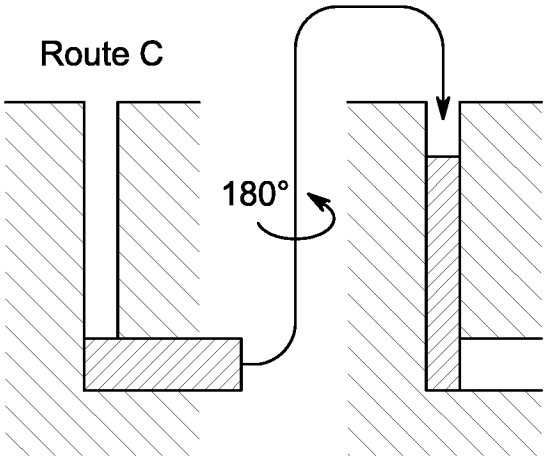
FIG. 4D shows a scheme of workpiece (tube) rotation between the individual ECAP passes in a multi-pass process including re-insertion and 180° turns.

In some embodiments, the strain simply accumulates between repeated passes of the workpiece through the die. Such a regime is called "Route A" and is illustrated accordingly in FIG. 4A. In this embodiment, the workpiece after extraction from the horizontal channel is re-inserted back into the vertical channel in the same orientation as previously. According to the "Route BA" (FIG. 4B), after extraction from the horizontal channel the workpiece is re-inserted into the vertical channel, and then turned by 90 degrees clockwise between the past and the next run, and then turned by 90 degrees counterclockwise between the next and after-the-next runs. This cycle of clockwise and counterclockwise turns continues between the multiple runs. According to the "Route BC" (FIG. 4C), after extraction from the horizontal channel, the workpiece is re-inserted into the vertical channel with rotation by 90 degrees clockwise. This rotation by 90 degrees continues between the next and after-the-next runs and so on along all intended ECAP runs. According to the "Route C" (FIG. 4D), after extraction from the horizontal channel, the workpiece is re-inserted into the vertical channel with rotation by 180 degrees clockwise, and this pattern continues between all individual runs of the ECAP process (See A. I. Korshunov, I. I. Vedernikova, L. V. Polyakov, T. N. Kravchenko, A. Smolyako and V. P. Solovie, *Reviews on Advanced Materials Science,* 2005, 10(3), pp. 235-238, incorporated herein by reference in entirety). The routes described herein are not limiting and different combinations of the routes are applicable, for example the route B120 would mean turning the workpiece by 120 degrees between the passes, the route CBC would mean following the route C between the passes 1 and 2, followed by the route BC between the passes 3 and 4.

Figure 5A:
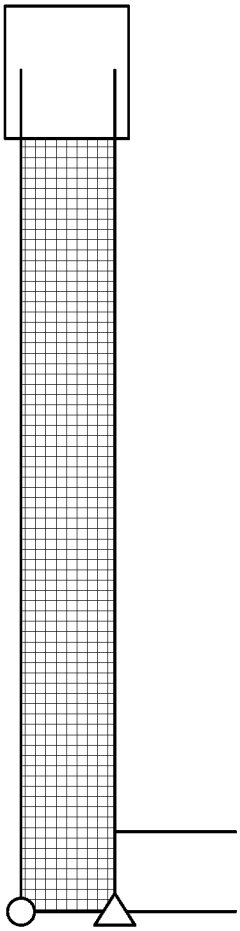
FIG. 5A shows a workpiece (tube) with a standard shape.
Figure 5B:
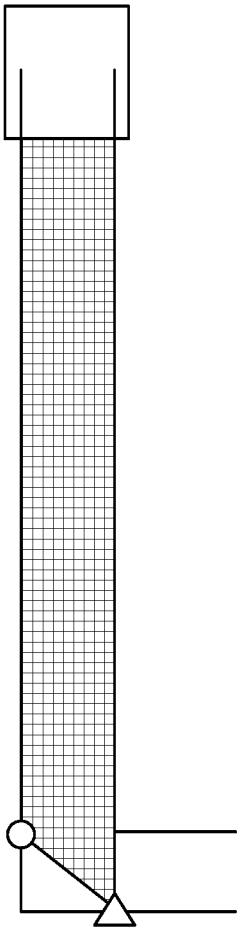
FIG. 5B shows a workpiece (tube) with a back slant shape.
Figure 5C:
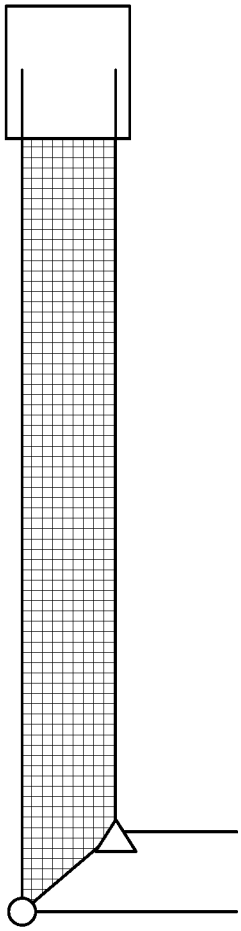
FIG. 5C shows a workpiece (tube) with a front slant shape.

In some embodiments, the strain is controlled by introducing the initial asymmetry in the workpiece (FIGS. 5A-5C). The plastic deformation behavior of workpieces having three different preform shapes during ECAP was investigated using experimental and finite element analyses (FIG. 5A—standard shape, FIG. 5B—back slant shape and FIG. 5C—front slant shape). The results indicated that a preform design slant at the back part of the workpiece head is beneficial to homogeneous deformation, reducing the maximum pressing load at the initial stage and eliminating folding defects at strain concentration points (see S. C. Yoon, M. H. Seo, H. S. Kim, *Scripta Materialia,* 2006, Volume 55, Issue 2, Pages 159-162), incorporated herein by reference in entirety.

Figure 6A:
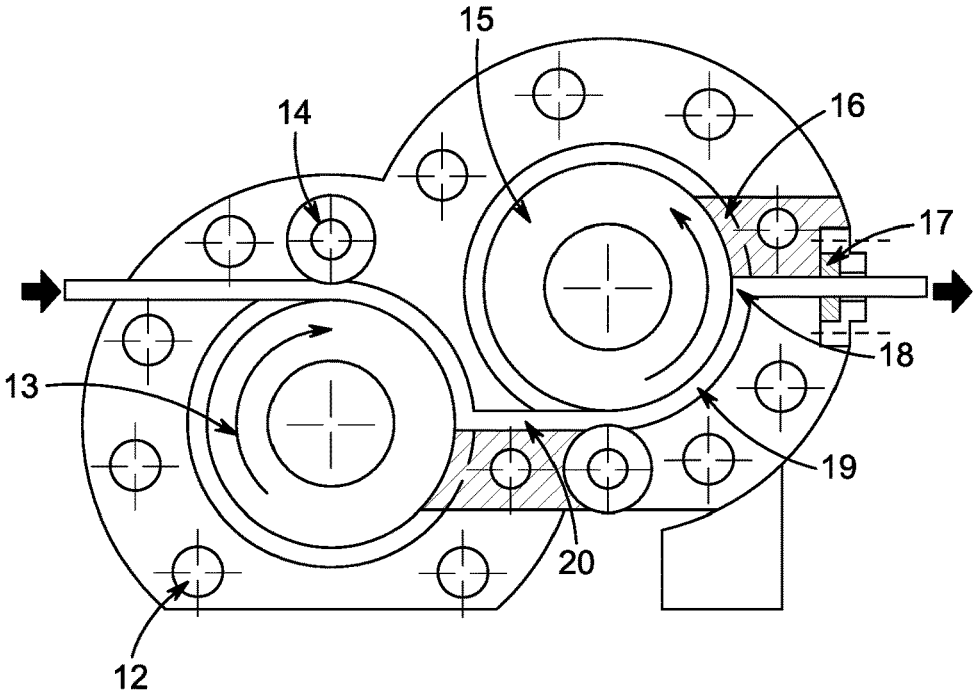
FIG. 6A shows ECAP variations with multiple turning angles.
Figure 6B:
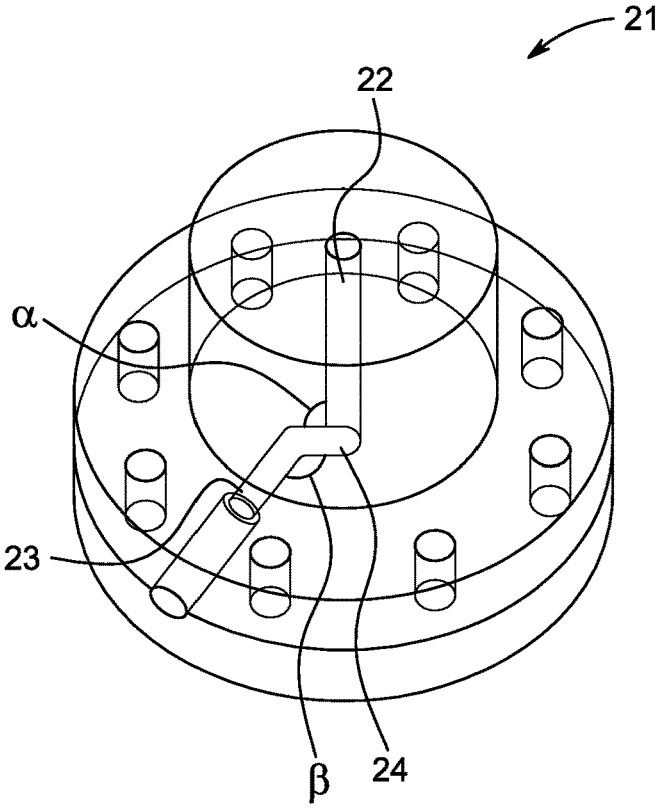
FIG. 6B shows an ECAP die path 2 turns each at 90 degrees.

Yet in other embodiments, the strain is controlled by introducing multiple turns and angles in the ECAP die path (FIGS. 6A-6B). Non-limiting examples of these approaches are incorporated herein by reference in entirety. In one embodiment (FIG. 6A) the rolling wheels 13 and 15 participate in strain management while rotating in the opposite directions. Additionally, the turning angles 7 and 9 are oppositely oriented, all together implementing an equivalent of a route C regime during a single ECAP pass (See CN108296297 A). In another embodiment (FIG. 6B) a more passive arrangement is made for 2 turns each at 90 degrees (angles alpha and beta) and in mutually compensating directions in terms of strain generation in channels 22, 23 and 24 (See US2019126333 A). The outcome is also equivalent to route C, achievable during a single process pass.

Industrial applicability of ECAP as a method of large-scale production depends on reproducibility. This reproducibility depends on multiple factors, each capable of introducing a variation. Among these factors are asymmetries in the die in the outer vs. the inner path, the edge effects (head and tail regions of the workpiece differ in the properties from the middle), temperature gradient between the core of the workpiece and the periphery, unequal distribution of pressure in the elements of volume in the die, lengthwise temperature gradient, non-stationary effects. Mechanical properties reach an optimum at a higher number of passes than electric or thermal conductivity. These discrepancies need to be addressed by the optimized construction of the ECAP equipment, as well as the optimized process regime.

In one non-limiting embodiment, the optimization of the apparatus is achievable by increasing length to cross-section ratio. The inhomogeneities associated with the edge effects, as well as the gradients of temperature and pressure in the cross-section are minimized when the cross-section to length ratio is minimized. The fraction of the product satisfying the pre-determined quality standards is increased by reducing the share of the edge effects. The exemplary and non-limiting range of the length-to-diameter ratios are above 10:1, preferably above 20:1, even more preferably above 50:1.

In another non-limiting embodiment, the apparatus may be operated by changing the turning angle from 90 degrees to a greater value of about 110-120, 120-130, 130-140 or 140-150 degrees without limitation and by introducing multiple oppositely directed turns with these greater angles (see FIG. 1A that presents the turning angle of about 150 degrees, showing that a greater angle means a lower strain). These designs are especially suitable for increasing heat and electric conductance and less suitable for affecting mechanical properties since multiple and oppositely directed greater turning angles lead to more balanced, lower and gradually introduced strain.

In yet another non-limiting embodiment, the advantageous process parameters are identified by use of multi-factor "black box" analysis. One non-limiting example is the use of a designed experiment or Box-Wilson experimental planning. Full factorial designed experiment is expensive, but the expenses are justifiable if reproducible quality at industrial scale is the purpose (See R. H. Myers, *Response Surface Methodology,* 1971, Boston: Allyn and Bacon, Inc., G. E. P. Box, and K. B. Wilson, *Journal of the Royal Statistical Society* Series, 1951, B13(1):1-45; R. H. Hardin and N. J. A. Sloane, *Journal of Statistical Planning and Inference,* 1993, vol. 37, pp. 339-369, incorporated herein by reference in entirety).

The factors that can be controlled in the framework of designed multifactorial experiment method are (as broad and non-limiting ranges) the rate of propagation (0.15-3 mm/sec), absolute pressure (1-1000 tons), choice of support (polyurethane rubber, other rubbers, coal, wood, particles, metals, grease), the absolute length of the die channel (0.1-10 m), absolute cross-section of the die channel ($5\times10$^-6 $m^2$-0.01 $m^2$), outside and inside angles (90-150 degrees), choice of routes, the shape of the workpiece, aspect ratios. The experimental outputs are heat conductivity (>17 W/m×sec for CP—Ti), tensile strength (>450 MPa for CP—Ti), fatigue resistance (subjected to three-point bending fatigue loading at a frequency ~100 Hz, should endure >5×10^6 cycles at room temperature 22° C. 5.0° C. for CP—Ti), ductility (wire made of post-processed titanium should demonstrate MBR/t<1.5 on wrap test for CP—Ti), surface hardness (>200 for Vickers Hardness), property homogeneity (IF<0.1 for the finished tube based on Inhomogeneity Factor (IF), measured by probing hardness along the length of the tube).

In still another non-limiting embodiment, the workpieces processed by ECAP undergo post-processing comprising, without limitation: simultaneous or intermediate annealing, post-process or simultaneous extrusion, hot pulling, simultaneous or post-ECAP rolling (cold or hot). The integration of ECAP with other processes is motivated by inhomogeneity of the processed workpieces and a high fraction of waste in a single isolated stage. For example, the tail and head portions of the ECAP product are of inferior quality as compared to the middle section due to edge effects. These discarded portions comprise up to 50% of the total length of the workpiece, are generated at the advanced stage of the technological process, comprise a pure metal that already underwent the annealing step, produce waste that requires disposal. An economically advantageous embodiment is to direct the primary rejects to the secondary ECAP channel of the same diameter but of a shorter length. The secondary rejects can be directed to a tertiary channel without limitation. The middle parts from the primary, secondary and tertiary ECAP channels in this embodiment are pooled and directed to a downstream process, preferably comprising hot extrusion at the second annealing temperature (the first being the temperature of the original pre-ECAP prototype annealing). The secondary post-ECAP annealing can be a distinct stage, and the annealing can be intermediate between the ECAP passes. Alternatively, and without limitation, the downstream process is hot pulling. Yet alternatively and without limitation, rolling is performed during ECAP pressing or as independent post-processing (FIG. 6A). Combining the upstream ECAP stage with the downstream methods introducing intense plastic deformation, especially introducing very high length to diameter ratios, the mechanical, thermo-conductive and electrical properties are homogenized, while the proportion of the rejected material needing recycling to a supplier or in-house rework is minimized. The merging of the upstream and downstream methods can be accomplished by the methods of a multifactor designed experiment.

Concerning the tubular cross-section, extrusion can be conducted via an annular extrusion die with the supporting whole-metal mandrel filling the hollow space within the pipe. The ratio of the pipe wall thickness to the thickness of the annular extrusion die characterizes the intensity of the post-ECAP deformation. The non-limiting examples of tube extruding technologies are provided in U.S. Pat. No. 9,895,733, UA107273C2, RU156044U, UA21073U, RU2100113C, U.S. Pat. No. 4,364,162A, CA1036763A and are incorporated herein by reference in entirety.

Diverse processing history of the metal workpiece is conducive to the synergistic improvement of mechanical properties above the levels reachable by individual components, including ECAP alone. The materials processed by the method combinations are more uniform at the level of microstructure and the heterogeneities expected after pooling the primary, secondary and tertiary ECAP products are decreased. Uniformity is promoted by the introduction of hydrostatic extrusion (HE), secondary annealing as finishing method, as well as any non-limiting combinations of the above. Even greater effects are observed in more complex processes, where the combinations of extrusion, rolling, pulling and annealing sandwich the ECAP step in the process sequence in any order and not following any theory.

Merging multiple methods in an empirically derived integrated approach leads to a more economical, waste-free technology compatible with the increased productivity of ECAP of the present invention.

EXAMPLES

Having generally described this disclosure, a further understanding can be obtained by reference to certain specific examples which are provided herein for purposes of illustration only and are not intended to be limiting unless otherwise specified.

Example 1: Nanocrystalline Ti Fabricated by Equal Channel Angular Pressing with Microcrystalline Cp Ti as Control Bulk nanocrystalline Ti bars (Grade 4, ϕ4×3000 mm3) were massively fabricated by equal channel angular pressing (ECAP) via follow-up conform scheme with the microcrystalline CP Ti as raw material. Homogeneous nanostructured crystals with the average grain size of 250 nm were identified for the ECAPed Ti, with extremely high tensile/fatigue strength (around 1240/620 MPa) and elongation more than 5%. The average grain size of the ECAPed Ti is about 250 nm, way smaller than that of 10-30 μm as the original grain size of the microcrystalline CP Ti control. Correspondingly alpha-Ti with hcp structure can be clearly demonstrated according to the typical Bragg peaks at featured degrees. The surface roughness and wettability of experimental samples were measured and the value of average roughness (Ra) varies from the range of 119.70-618.93 nm to the range 58.13-68.72 nm for CP Ti and the ECAPed Ti respectively. The values of root mean squared (RMS) microroughness and P-V macroroughness are also listed to show a specific characterization, from which much lower microroughness is obtained for the ECAPed Ti. As for surface wettability, enhanced hydrophilicity with a lower contact angle (61.43 degrees) exists for the ECAPed Ti compared with that of original CP Ti (62.12 degrees). Table 3 displays the mechanical properties of CP Ti and the ECAPed Ti after the tensile tests under the ambient temperature. The refinement of grains brings about significant enhancement of strength for CP Ti, as can be seen that the yield strength of nanocrystalline ECAPed Ti increases by 100% (559 MPa vs. 1190 MPa) and the ultimate tensile strength increases by 70% (712 MPa vs. 1240 MPa). The separate data in rupture strength and elongation does not exceed 3%, which reveals that the formed nanostructure is homogeneous within the body of the ECAPed Ti. Instead of the typical strength-ductility behavior induced by conventional rolling or drawing, the ductility of the ECAPed Ti goes down in comparison to that of CP Ti,

TABLE 3

Mechanical Properties of Pure Ti Before and After SPD Treatments

| Samples | $r_{UTS}$, MPa | $r_{0.2}$, MPa | d, % | w, % | FS, MPa |
|---|---|---|---|---|---|
| CP Ti (certificate data) | 712.0 6 17.0 | 559.5 6 41.7 | 26.0 6 1.4 | 49.5 6 3.5 | 340 6 22.3 |
| ECAPed Ti | 1240 6 116.4 | 1190 6 14.1 | 11.5 6 0.7 | 45.5 6 5.0 | 620 6 50.8 |

$r_{UTS}$ = ultimate tensile strength,
$r_{0.2}$ = yielding stress,
d = elongation, and
w = reduction of area;
FS = fatigue strength, which refers to the mechanical strength at $10^6$ cycles.

Example 2: Equal Channel Angular Pressing of Titanium Tube

In Example 2, two types of samples were subjected to ECAP: 1) tubes made of CP—Ti grade 2 filled with different (metallic and non-metallic) mandrel materials and 2) solid, cylindrical bolts made of the same materials as the metallic mandrels. Both sample types had the same dimensions: outer diameter of 20 mm and length of 120 mm. The wall thickness of the tubes was 2 mm and thus the inner diameter was 16 mm. Mandrel materials consisted of the metals CP aluminum (hereafter abbreviated to CP—Al), CP—Ti grade 2 (CP—Ti)—nominal the same as the tube material, however, with different mechanical properties in the as-received (AR) condition and the Ti-6Al-4V alloy (Ti64) as well as of two nonmetals: graphite (C) and oak wood (oak). Two ECAP tools with a channel diameter of 20 mm and with different angles of intersection (120° and 105°) were used. Routes BC, B120 and C, in which between subsequent passes the billet is rotated in the same direction by 90°, 120° and 180°, respectively, were applied. Both tools and samples were held at the same, constant temperature during the whole process, whereby, if needed, the samples were preheated before the first ECAP pass in an air furnace for 20 minutes. A graphite-based anti-seize paste Molykote® P-74 was used as lubricant between the walls of the die and the workpiece. The critical processing parameters, particularly temperatures and angles of intersection, were adjusted to the mandrel materials and are listed together with routes in Table 4. Thus, for the Ti64 core 500° C. had to be chosen regardless of the fact, that the temperature is too high for processing pure titanium. In general, one of the aims of the study was to conduct ECAP on Ti tubes at the lowest possible temperature, compatible with polyurethane stability. In fact, for CP—Al and non-metallic mandrel cores, temperatures as low as 100° C. and even RT were used. Further, it was intended to reveal the homogeneity of the microstructure particularly to clarify whether the shear deformation originating at the point of channels' intersection can spread through the mandrel, especially the non-metallic ones, and reach the outer section of the sample. Therefore, ECAP with one single pass as well as a higher (optimum) number of passes was performed. Table 4 below presents different regimes of treatment and the accompanying conditions used in this Example.

TABLE 4

ECAP parameters for CP-Ti tubes with different mandrel materials.

| Mandrel material | | Number of passes and route | Temperature [°C.] | Angle of intersection [°] | Total uniform equivalent strain acc. [1] |
|---|---|---|---|---|---|
| Metallic | CP-Al | 1x | 100 | 105 | 0.9 |
| | | 2xC | | | 1.8 |
| | CP-Ti | 1x | 400 | 105 | 0.9 |
| | | $6xB_{120}$ | | | 5.3 |
| | Ti64 | 1x | | | 0.6 |
| | | 4xBC | 500 | 120 | 2.5 |
| Non-metallic | C | 1x | RT | | |
| | | | 100 | 105 | 0.9 |
| | | 1x | 100 | 105 | 0.9 |
| | oak | 2xC | RT | 120 | 1.3 |
| | | 4xCBC* | 100 | 120 | 2.5 |

*Rotation sequence: 180°, 90° and 180°

Example 3: Methods of Study of Mechanical Properties

Vickers hardness measurements (HV1) were performed on cross-sections perpendicular to the ECAP direction using a fully automatic hardness tester (EMCO-TEST DuraScan 80) according to EN ISO 6507-1. Hardness mappings on the entire cross-section of the tubes as well as of the cores were performed with a mesh of 0.5×0.5 mm2 to reveal the respective hardness distributions. All tensile tests were carried out at RT according to ISO 6892-1 A222 procedure with an initial strain rate of 3×10-4 s-1. A computerized universal Shimadzu Servopulser EHF-UV050K1 testing machine equipped with a high-precision clip-on extensometer was used. Two types of tensile samples were used. First, thread-end test pieces of round cross-section of type B6×30 according to DIN 50125 obtained by turning from mandrel materials—in as-received (AR) state, as cores of tubes as well as solid bolts after ECAP—were tested. This approach ensured the highest precision of the data. At least two samples per condition were tested to single out possible outliers. Second, properties of the tube material—both AR and after ECAP—were obtained on test pieces analogous to DIN 50125-E2×5×20. Four samples per tube were fabricated to obtain an average value. The two-piece of tube AR, tube after transverse surfaces were machined by spark erosion to tight ECAP and cutting of tensile tolerances whereas the original thickness of the wall remained unchanged.

Example 4: Characterisation of Mechanical Properties of Titanium Tubes with Various Mandrels The results of the hardness test on tubes are shown as numerical data (mean value) in Table 5. Processing tubes with a graphite mandrel by ECAP is feasible, but only for one pass. Even so, a vast increase in hardness occurs due to the low deformation temperature (from 180 HV1 in AR condition to 233 HV1 and 217 HV1 after one ECAP pass at 100° C. and RT, respectively). Also, in the case of tubes with oak mandrel a significant increase in hardness (212 HV1) as well as an inhomogeneous hardness distribution after one pass at 100° C. were observed. Moreover, several ECAP passes could be performed and resulted in very high hardness (220 HV1 after 2×C at RT and 224 HV1 after 4×CBC at 100° C.) as well as in fairly homogenous hardness distributions. However, oak was the only mandrel material that did not preserve the dimensions of the tube during ECAP processing. The tubes partially collapsed and a shortening, as well as roughly a nonuniform doubling in wall thickness, occurred due to the compressibility of wood. Similar challenges are expected to limit the life-span of polyurethane mandrels after multiple compression cycles.

As CP—Al is a quite soft metallic mandrel material the ECAP temperature can be as low as 100° C. This effectively increased the hardness of the CP—Ti tube, even after one pass, and resulted in a quite uniform hardness distribution on the cross-section of the tube after only 2 passes with route C. CP—Ti as mandrel material leads to a homogenous hardness distribution as well, though, many passes (6) are needed for an increase in hardness compared to the AR material. This is due to the higher processing temperature of 400° C. used for this rather strong mandrel material (the mandrel needs to deform together with the supported tube and the heat of deformation work is evolved, increasing the temperature, the increased temperature causes "recovery", a partial reversal of crystallite fragmentation under shearing stress, thus conducting ECAP under lower temperatures is desired to prevent "recovery").

Using mandrels made of Ti64 the ECAP processing temperature had to be even higher (500° C.) resulting in rather low hardness values, as a matter of fact, in case of only one ECAP pass even lower than in the AR condition. However, tensile properties improved. In the case of non-metallic mandrels, no investigations of mechanical properties were performed. ECAP of metals as mandrels in CP—Ti tubes leads to higher hardness values and slightly more homogenous hardness distributions (for CP—Ti mandrels) than conventional ECAP processing of solid bolts.

The numerical results of tensile tests on CP—Ti tubes are summarized in Table 4. In all cases the yield strength and the ultimate tensile strength (UTS) are increased by ECAP, even at the highest processing temperature of 500° C., which is somehow contrary to the hardness measurements. This is due to a strong texture in the AR condition. The enhancement of the UTS is quite substantial; up to 50% increase is obtained after 6 passes at 400° C. with CP—Ti as mandrel or even after one single pass at 100° C. with CP—Al as mandrel. A moderate decrease in total elongation is mostly observed after one pass and a further reduction occurs after 6 passes, however, the ductility is still reasonable. Furthermore, a substantial reduction in uniform elongation due to a change in the strain hardening coefficient takes place, which is typical for ECAP materials. The results of tensile tests on metallic mandrel materials as well as on solid ECAP bolts of the same materials after the same ECAP deformation are summarized in Table 5. In the case of CP—Al the improvement of UTS is in the range of 20-250. The highest increase in tensile strength is obtained for CP—Ti after 6 passes at 400° C. (+370%).

TABLE 5

Mechanical properties of CP-Ti tubes and mandrel materials. The latter were either ECAP processed as solid bolts (S) or as mandrels of CP-Ti tubes (M). YS denotes yield strength, UTS is the ultimate tensile strength, Ag [%] percentage uniform elongation, A[%] percentage elongation after fracture.

| | | Tubes | | | | | Mandrel materials | | | | | |
|---|---|---|---|---|---|---|---|---|---|---|---|---|
| Mandrel material | ECAP conditions | HV1 | YS [MPa] | UTS [MPa] | Ag [%] | A [%] | ECAP | HV1 | YS [MPa] | UTS [MPa] | Ag [%] | A [%] |
| CP-Al | AR | 180 | 289 | 427 | 15 | 27 | | 73.5 | 198 | 223 | 7 | 18 |
| | 1x, 100° C., 105° | 209 | 543 | 608 | 2.5 | 15 | S | 90.8 | 269 | 275 | 2.3 | 13 |
| | | | | | | | M | 92.6 | 266 | 276 | 2.8 | 13 |
| | 2xC, 100° C., 105° | 227 | — | — | — | — | S | 92.3 | 263 | 267 | 2.0 | 15 |
| | | | | | | | M | 80.0 | — | — | — | — |
| CP-Ti | AR | 180 | 289 | 427 | 15 | 27 | | 202 | 413 | 494 | 11 | 39 |
| | 1x, 400° C., 105° | 178 | 432 | 491 | 5.5 | 28 | S | 208 | 527 | 576 | 4.2 | 28 |
| | | | | | | | M | 213 | 547 | 602 | 4.4 | 25 |
| | $6B_{120°}$, 400° C, 105° | 194 | 507 | 585 | 2.5 | 13 | S | 226 | 591 | 655 | 3.1 | 21 |
| | | | | | | | M | 230 | 609 | 676 | 2.2 | 22 |
| Ti64 | AR | 180 | 289 | 427 | 15 | 27 | | 346 | 977 | 1024 | 6 | 18 |
| | 1x, 500° C., 120° | 174 | 422 | 494 | 7.5 | 20 | S | 356 | 1138 | 1152 | 1.1 | 10 |
| | | | | | | | M | 361 | 1125 | 1146 | 0.9 | 11 |

The present disclosure demonstrates the effectiveness and advantages of processing tubular titanium samples by ECAP. By selecting proper mandrel material (polyurethane) it is possible to considerably reduce the pressing force and therefore to lower the ECAP temperature of CP—Ti. This leads to a vast increase in hardness and strength of CP—Ti tubes, even higher than what can be obtained in solid titanium rods by numerous ECAP passes at elevated temperatures. E.g. the highest hardness was reached after only one pass at 100° C. with C as a mandrel (233 HV1). However, close attention should be paid to the homogeneity of the microstructure especially when non-metallic mandrels are used in consequence of nonuniform plastic deformation during processing: The sample area in the vicinity of the channels' intersection undergoes typical ECAP deformation by simple shear, whereas the opposite side of the tube is simply bent. The most uniform hardness distribution on tube cross-sections were achieved with CP—Ti as mandrel material after 6 passes at 400° C. using route BC. Using mandrel materials with higher strength than the tube material (e.g. Ti64) requires higher ECAP temperatures than necessary for pure titanium resulting in rather low mechanical properties after ECAP ("recovery" problems). Therefore, soft metallic materials, e.g. pure Al, are recommended for mandrels. CP—Al leads to the highest hardness of the CP—Ti tube compared to all other metallic mandrel materials tested, however, the hardness is lower than in case of C. Mechanical properties of metals processed by ECAP as mandrels encapsulated in CP—Ti tubes are better (CP—Ti, Ti64) or at least the same (CP—Al) as properties of these materials after conventional ECAP deformation in the form of solid bolts under the same conditions.

It is of note, based on embodiments in Example 4 that non-metallic mandrels produce the very divergent and unpredictable results. The use of polyurethane provides titanium tubes of much improved properties and process reproducibility.

The experimental data provided in the Examples 2-5 point to a significant variability and unpredictable nature of the ECAP outcomes for the tubular constructs. For titanium, the method failed with oil, wood and carbon mandrel supports (too hard, low processivity, deformable). Only metallic mandrels and polyurethane rubbers were reliable mandrel materials. However, the energy required to bend and deform the whole-metal mandrel bolts is high and leads to increases in processing temperature that could cause recrystallization and reversal of ECAP effects (termed "recovery"). At higher diameters of the hollow objects and at high wall thickness, the method relying on whole-metal mandrels will be limited by the maximal pressure produced by the hydraulic press and by the release of waste heat. In contrast, polyurethane allows the same processing to proceed at room temperature, leading to faster improvement of mechanical properties.

The possibility of casting the polyurethane support in the form of a heat-activated reactive mix with the fillers of desired properties allows infinite versatility of forms and sizes of hollow objects to be rapidly processed. While most of the applications are to the round tubes, the hollow parts of more diverse cross-sections can be processed with elastic supports disposed inside and (if the shape requires) outside of the metal wall. These properties make polyurethane not only the most reliable and tested non-metal mandrel for tubing, but a unique special case material for organizing an industrial-scale production of pure titanium (or alloyed) tubing strengthened by a combination of methods.

The invention claimed is:

1. A process for Equal Channel Angular Pressing (ECAP) machining to form a fine grain titanium round tube, comprising:

filling a hollow titanium round tube workpiece with a polyurethane reaction mixture comprising titanium powder to form an uncured filled workpiece, curing the polyurethane reaction mixture and annealing the hollow titanium round tube workpiece by heating the uncured filled workpiece to form an ECAP workpiece filled with a hard polyurethane mandrel, ECAP machining the ECAP workpiece through a die having an angular element to form the fine grain titanium round tube, wherein the titanium grain size of the fine grain titanium round tube is in the range from 150 nm to 500 nm.

2. The process of claim 1, wherein the hollow titanium round tube workpiece is pure CP—Ti titanium metal.

3. The process of claim 1, wherein the polyurethane reaction mixture comprises the titanium powder in an amount of 30% to 60% percent by weight of the polyurethane reaction mixture.

4. The process of claim 1, wherein the polyurethane reaction mixture comprises the titanium powder in an amount of 30% to 50% percent by weight of the polyurethane reaction mixture, and rounded sand in an amount of 15-25% by weight of the polyurethane reaction mixture.

5. The process of claim 1, wherein the angular element of the die during the ECAP machining is a turning angle selected from the group consisting of 100-110°, 110-120° and 120-130°.

6. The process of claim 1, further comprising:

annealing the fine grain titanium round tube subsequent to the ECAP machining.

* * * * *